US012104889B2

(12) United States Patent
Feda

(10) Patent No.: US 12,104,889 B2
(45) Date of Patent: Oct. 1, 2024

(54) WIRELESS MULTI-FUZE SETTER INTERFACE

(71) Applicant: BAE Systems Information and Electronic Systems Integration Inc., Nashua, NH (US)

(72) Inventor: Francis M. Feda, Sudbury, MA (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 71 days.

(21) Appl. No.: 17/924,226

(22) PCT Filed: May 12, 2021

(86) PCT No.: PCT/US2021/032001

§ 371 (c)(1),
(2) Date: Nov. 9, 2022

(87) PCT Pub. No.: WO2021/242524

PCT Pub. Date: Dec. 2, 2021

(65) Prior Publication Data

US 2023/0184527 A1 Jun. 15, 2023

Related U.S. Application Data

(60) Provisional application No. 63/023,520, filed on May 12, 2020.

(51) Int. Cl.
*F42C 17/04* (2006.01)

(52) U.S. Cl.
CPC ..... *F42C 17/04* (2013.01)

(58) Field of Classification Search
CPC ..... F42C 17/00; F42C 17/02; F42C 17/04
(Continued)

(56) References Cited

U.S. PATENT DOCUMENTS 7,698,983 B1 4/2010 Pinto et al.
7,926,402 B2 * 4/2011 Pikus ..... F42C 11/065 89/6

(Continued)

FOREIGN PATENT DOCUMENTS

DE 38 27 374 C1 7/1994
KR 20200092657 A 8/2020
WO 2019/199794 A1 10/2019

OTHER PUBLICATIONS

International Search Report, PCT/US21/32001, mailed Dec. 7, 2021, 12 pages.
EP Search Report, EP 21 81 3695, mailed Apr. 19, 2024, 11 pages.

*Primary Examiner* — John Cooper
(74) *Attorney, Agent, or Firm* — Scott J. Asmus; Gary McFaline

(57) ABSTRACT

Techniques and architecture are disclosed for a wireless fuze setter interface, comprising an electronics subsystem comprising a plurality of ports and a plurality of output interfaces having a common interface with the plurality of ports on the electronics subsystem. The plurality of output interfaces comprises an electrical energy transfer zone configured to provide electrical energy to the fuze, and a high speed data communications zone configured to transfer fuze setting data to the fuze. The wireless fuze setter interface provides fuze setting capability without the need for rotational or other physical alignment between the fuze and the fuze setter.

18 Claims, 25 Drawing Sheets

(58) Field of Classification Search
USPC ..... 89/6, 6.5
See application file for complete search history.

(56) References Cited

U.S. PATENT DOCUMENTS

| | | | | |
|---|---|---|---|---|
| 8,490,533 | B2 * | 7/2013 | Reynard | F42C 11/04 89/6 |
| 9,472,971 | B2 | 10/2016 | Soar | |
| 10,852,116 | B2 | 12/2020 | Feda | |
| 10,962,341 | B2 | 3/2021 | Feda et al. | |
| 2005/0061191 | A1 | 3/2005 | Dietrich et al. | |
| 2005/0126379 | A1 | 6/2005 | Pikus et al. | |
| 2009/0217836 | A1 | 9/2009 | Dietrich et al. | |
| 2012/0011991 | A1 * | 1/2012 | Magnan | F42C 17/04 89/6 |
| 2012/0159188 | A1 * | 6/2012 | Boneh | H04L 9/0847 713/189 |
| 2016/0341532 | A1 * | 11/2016 | Owen | F42C 17/04 |
| 2020/0263966 | A1 | 8/2020 | Larsson et al. | |
| 2020/0348117 | A1 | 11/2020 | Feda | |

* cited by examiner

WIRELESS MULTI-FUZE SETTER INTERFACE

CROSS-REFERENCE TO RELATED APPLICATIONS

This application claims the benefit of U.S. Provisional Patent Application No. 63/023,520, filed on May 12, 2020, which is herein incorporated by reference in its entirety.

FIELD OF THE DISCLOSURE

The following disclosure relates generally to fuze setter interfaces, more specifically wireless fuze setter interfaces for next generation programmable precision guided munitions (PGM) or legacy munitions which incorporate programmable precision guidance kits (PGKs).

BACKGROUND

Generally, platforms that launch projectiles that employ PGKs may utilize autoloader mechanisms in order to achieve a high rate of fire. However, these PGKs must be programmed with requisite mission data prior to launch. Such mission data could include waypoint reference imagery for image-based navigation, which presents a significant increase in the amount of data as compared to that required for older first generation PGKs. As next generation PGKs become more complex and require a significant amount of data loaded onto the fuze, programming larger amounts of data requires more time. However, the time available for programming such data is often limited in current autoloader mechanisms to a single launch cycle. Electrical energy may also need to be transferred to the fuze from the fuze setter to sustain fuze operation during both the fuze setting process and also during the time interval from when the fuze setter has been disconnected until the fuze internal power system is enabled. Therefore, there is a need for high speed data communications and electrical energy transfer in order to support the high rate of fire capability of an autoloader.

SUMMARY

An example embodiment of the present disclosure provides a wireless fuze setter interface, including an electronics subsystem having a plurality of ports and a plurality of output interfaces having a common interface with the plurality of ports on the electronics subsystem. The plurality of output interfaces includes an electrical energy transfer zone configured to provide electrical energy to the fuze, and a high speed data communications zone configured to transfer fuze setting data to the fuze, wherein the wireless fuze setter interface provides fuze setting capability without the need for rotational alignment between the fuze and the fuze setter.

Particular implementations may include one or more of the following features. The electrical energy transfer zone may include an electrical energy transfer coil. The communications zone may include a communications transceiver capable of bidirectional communications. The communications transceiver may be an antenna. The communications transceiver may be an inductive coil.

Another example embodiment provides a wireless fuze setter interface for setting multiple fuzes including an electronics subsystem comprising a plurality of ports and a plurality of output interfaces having a common interface with the plurality of ports on the electronics subsystem. The plurality of fuze setter output interfaces includes an electrical energy transfer zone configured to provide electrical energy to one or more fuzes, wherein the electrical energy transfer zone spans a plurality of fuzes, and a high speed data communications zone configured to transfer fuze setting data to one or more fuzes that in one example is done concurrently. The communications zone spans a plurality of fuzes, and the fuze setter interface provides fuze setting capability without the need for physical alignment between the fuze and fuze setter interface ports.

Particular implementations may include one or more of the following features. The electrical energy transfer zone may be a single fuze electrical energy transfer zone coupled with a single fuze communications zone. The electrical energy transfer zone may be a multi-fuze electrical energy transfer zone coupled to a single fuze or multi-fuze communications zone. The communications zone may include a communications transceiver capable of bidirectional communication. The communications transceiver may be an antenna. The communications transceiver may be an inductive coil. The high speed data communications zone may be configured to wirelessly transfer the fuze setting data.

Another example embodiment provides a method for setting a fuze. The method includes bringing a fuze into a fuze setting station and moving the fuze through a fuze setting zone. The fuze setting zone includes a communications zone and an electrical energy transfer zone. The electrical energy transfer zone powers up the fuze, and the communications zone configures the fuze by transferring data necessary for launch configuration. The method includes transferring the fully configured fuzed projectile to a feed tray to await launch.

Particular implementations may include one or more of the following features. The communications zone may be a single fuze communications zone. The communications zone may be a multi-fuze communications zone. The electrical energy transfer zone may be a single fuze electrical energy transfer zone. The electrical energy transfer zone may be a multi-fuze electrical energy transfer zone.

Implementations of the techniques discussed above may include a method or process, a system or apparatus, a kit, or a computer software stored on a computer-accessible medium. The details or one or more implementations are set forth in the accompanying drawings and the description below. Other features will be apparent from the description and drawings, and form the claims.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the inventive subject matter.

These and other features of the present embodiments will be understood better by reading the following detailed description, taken together with the figures herein described. The accompanying drawings are not intended to be drawn to scale. For purposes of clarity, not every component may be labeled in every drawing.

DETAILED DESCRIPTION

This disclosure relates to a wireless fuze setter interface system and process comprising an electronics subsystem comprising a plurality of ports and a plurality of output interfaces having a common interface with the plurality of ports on the electronics subsystem. The plurality of output interfaces comprises an electrical energy transfer zone configured to provide electrical energy to the fuze, and a high speed data communications zone configured to transfer fuze setting data to the fuze. The wireless fuze setter interface provides fuze setting capability without the need for rotational or other physical alignment between corresponding fuze and fuze setter interfaces.

Precision guided kit (PGK) fuzes for precision guided munitions (PGMs) are programmed prior to launch in a process known as fuze setting. As used throughout the disclosure herein, PGKs refer to any of the programmable aspects of a PGM. Fuze setting is the process in which data necessary for the fuze and PRM to perform the desired mission is communicated to the fuze; fuze functional checks are performed; and fuze status information is communicated back to the fuze setter. This fuze setting process occurs on each individual fuze prior to launch. The amount of time needed for each fuze setting is dictated by numerous factors. Factors can include boot-up and initialization time for the fuze; the size of the fuze setting data; processing, distribution, and integrity checks of the fuze data; and functional status checks. Based on the factors involved in the fuze setting process, the requisite time needed for fuze setting may exceed the actual time available based on the desired rate of fire of the artillery platform. As a result, programming and setting the fuzes can become a limiting factor in terms of the maximum rate of fire attainable by the artillery platform.

Thus, and in accordance with an embodiment of the present disclosure, techniques and architecture are disclosed for a wireless fuze setter interface comprising an electronics subsystem comprising a plurality of ports and a plurality of output interfaces having a common interface with the plurality of ports on the electronics subsystem. The fuze setter interface may also be configured for use on multiple fuzes concurrently.

Figure 1:
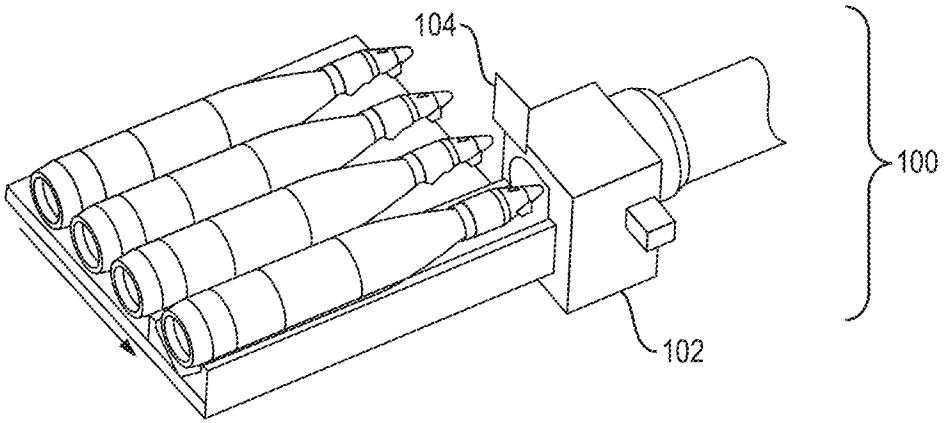
FIG. 1 (PRIOR ART)
FIG. 1 is an illustration of a conventional fuze setting system.

FIG. 1 is an illustration of a conventional fuze setting system as seen in the conventional art. On a platform 100, such as an artillery gun platform, outfitted with an autoloader mechanism 102 for rapidly feeding projectiles into the gun or launcher, the conventional fuze setting systems within the autoloader 102, like that of FIG. 1, only contain a single fuze setting zone 104. This limits the amount of time available for fuze setting based on the rate of fire, and thus limits the amount of data that can be loaded onto a fuze prior to launch. This becomes problematic as next generation fuzes become more complex and require greater amounts of data to be loaded. In addition to limiting the amount of data that can be sent, a single fuze setting zone 104 also limits the amount of time available to transfer the data and perform any other fuze setting operations. If the communication rate for the fuze setter is already operating at its maximum capability, then a longer period of time is required to send greater amounts of data. Because conventional fuze setting systems only have a single fuze setting zone 104, the complexity of fuze setting that can occur is further limited by the time it takes for a single gun launch cycle.

Figure 2A:
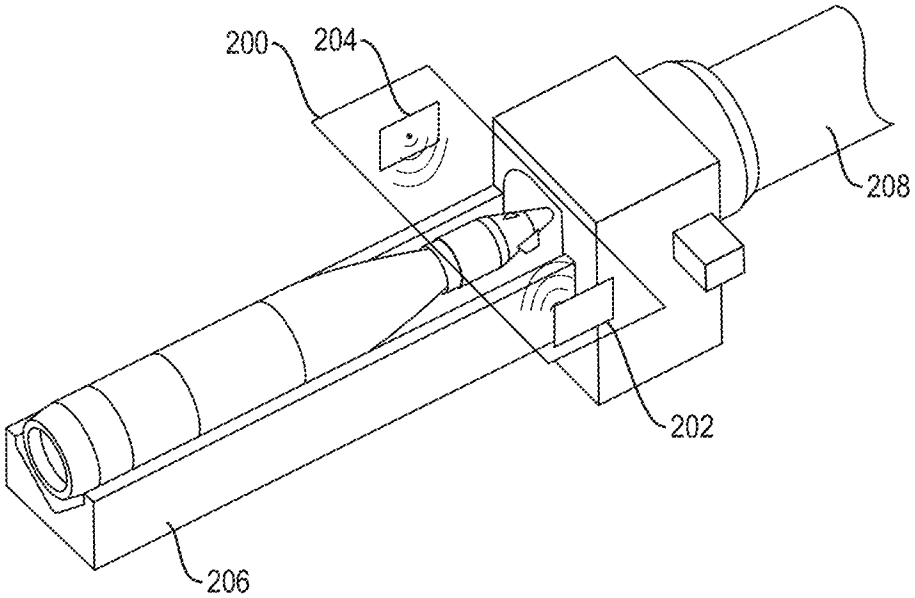
FIGS. 2A, 2B, and 2C are illustrations of various configurations for a wireless fuze setter interface in some embodiments of the present disclosure.
Figure 2B:
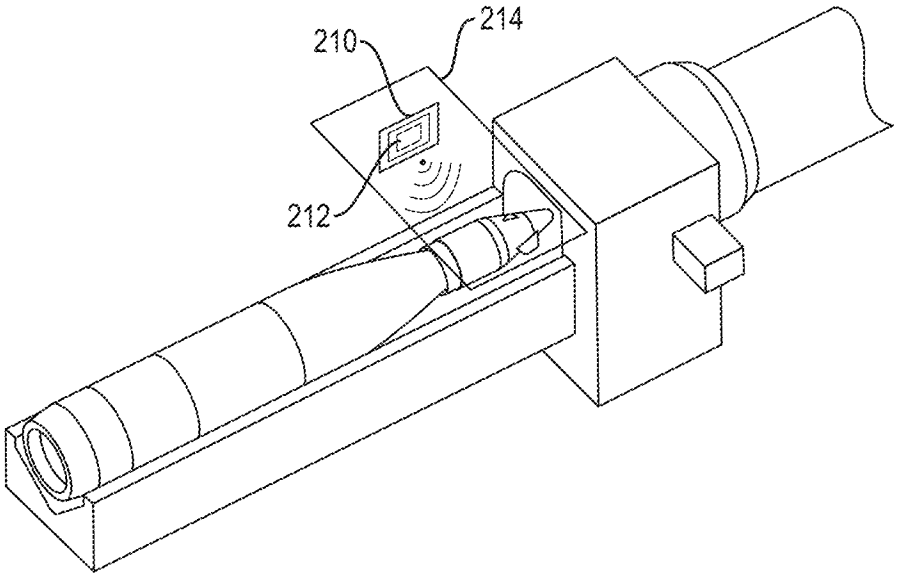
Figure 2C:
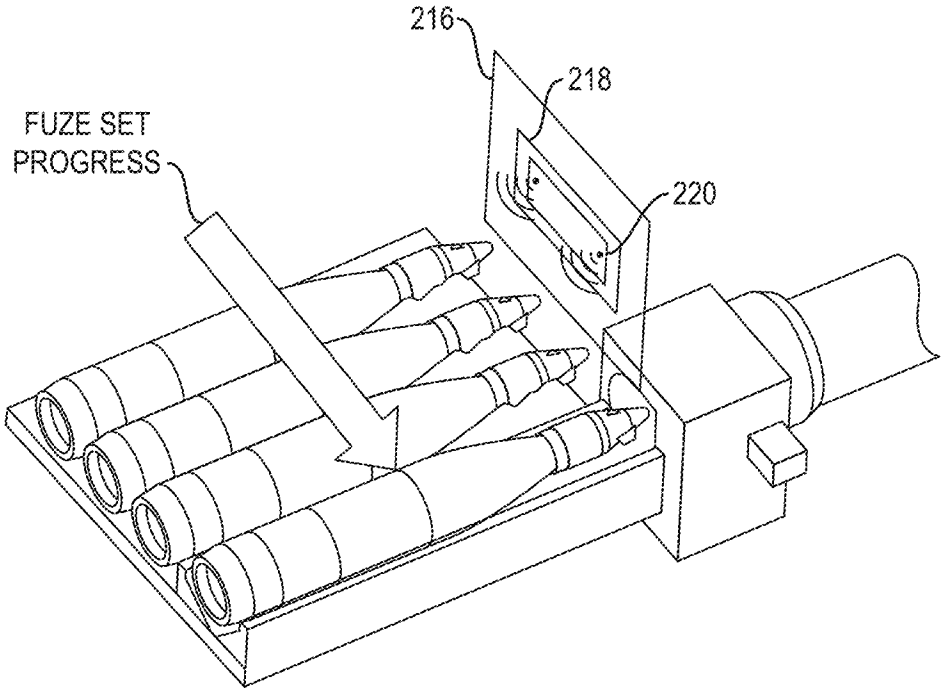

FIGS. 2A, 2B, and 2C illustrate various configurations for a wireless fuze setter interface in accordance with an embodiment of the present disclosure. In one embodiment as shown in FIG. 2A, the wireless fuze setter interface 200 is dual-sided, where an electrical energy transfer zone containing an electrical energy transfer coil 202 is on one side of the fuze and a communications zone containing a communications antenna 204 is on the other side. This configuration may be appropriate for use with autoloader configurations whereby multiple projectiles are arranged in the feed tray 206 in an end-to-end orientation, with one projectile behind the one preceding it in the feed tray 206. After the fuze setting process, the fuzed projectile enters the launch tube 208 for launch. In another embodiment as shown in FIG. 2B, the wireless fuze setter interface 214 is single-sided, where an electrical energy transfer zone containing an electrical energy transfer coil 210 and a communications zone containing a communications antenna 212 overlap to create a fuze setting zone on one side of the fuze. This embodiment may be appropriate in autoloader configurations that may be space constrained, or otherwise potentially incompatible with the dual-sided interface of FIG. 2A. Both of these embodiments allow for one fuze to be programmed at a time, although multiple fuze setters can be used along the feed tray if there was adequate space.

In another embodiment as shown in FIG. 2C, the wireless fuze setter interface 216 spans multiple fuzes, thus creating a multi-fuze setting zone thereby allowing for the setting of multiple fuzes. In this configuration the feed tray places the PGM adjacent to each other. An electrical energy transfer zone containing an electrical energy transfer coil 218 and a communications zone containing a communications antenna 220 can overlap while also spanning several fuzes in line for launch. This arrangement allows for fuzes to be set in a pipelined manner, beginning when the fuze setter detects a new fuze entering the setting zone, and continuing until setting is complete. As a result, multiple fuzes can be programmed concurrently.

Figure 3:
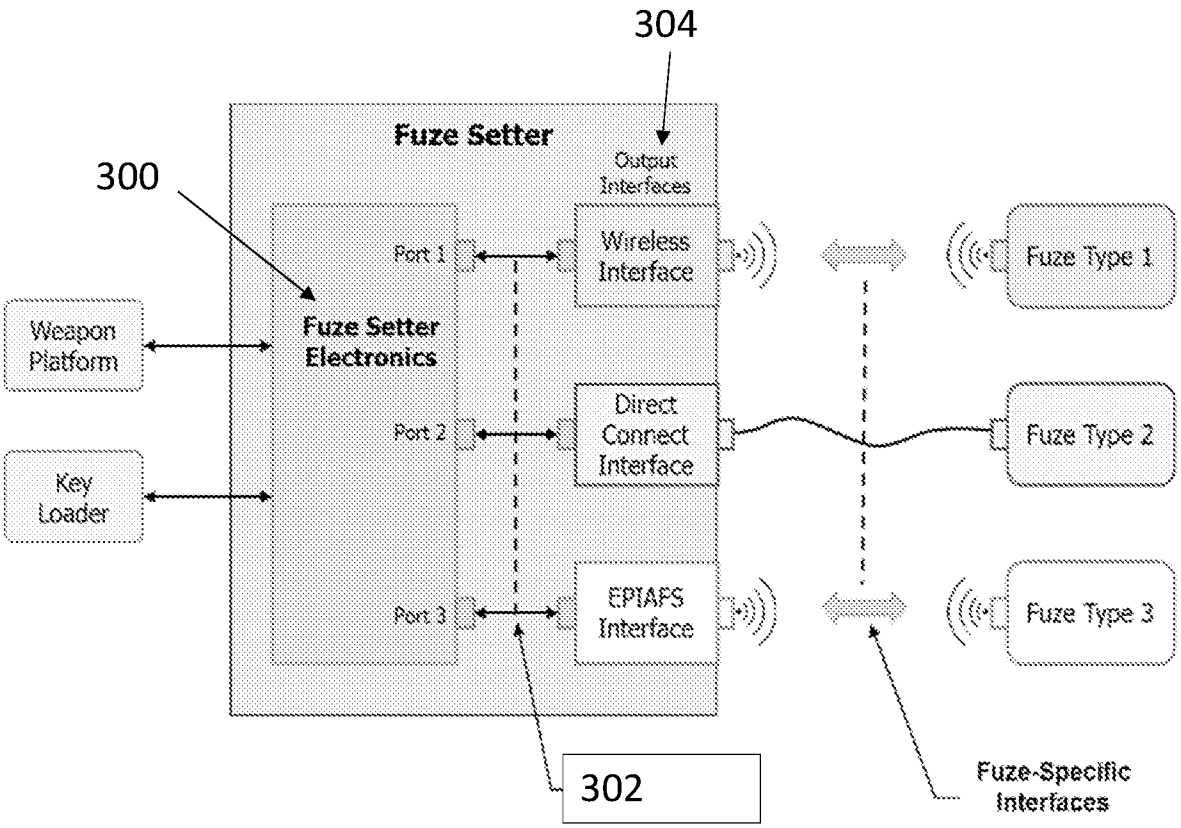
FIG. 3 is a diagram of a modular fuze setter interface that is capable of interfacing between a common weapon platform and different fuze types according to one embodiment.

FIG. 3 illustrates a wireless fuze setter interface configuration that is compatible with multiple fuze types, multiple platforms, and for both current and legacy, as well as future fuze types. In accordance with an embodiment of the present disclosure, a fuze setter electronics subsystem 300 will have a common interface 302 with one or more output interfaces 304 via ports. The output interfaces 304 can include, but are not limited to, wireless interfaces, direct connect interfaces, and Enhanced Portable Inductive Artillery Fuze Setter (EPIAFS) interfaces. These output interfaces 304 will have fuze-specific interfaces for a variety of fuze types, thereby allowing the fuze setter to be universally compatible with different fuze requirements. There may be multiple, different fuze variants, in terms of versions and types, that communicate using each of the different output interface types discussed above. There may be multiple, different fuze variants that share a common interface with the fuze setter. In one embodiment, there are multiple fuze types that all use a wireless interface on the fuze setter of the present disclosure. Additionally, these output interfaces 304 can translate electrical energy, data communications, and discrete signals from the fuze setter to the fuze in a form compatible with whatever fuze type is being used and on any platform whether airborne, maritime of land based. In one embodiment, data communications occurs in a bi-directional manner between the fuze setter and the fuze. In another embodiment, discrete signal communications and electrical energy transfer are uni-directional from the fuze setter to the fuze.

Figure 4A:
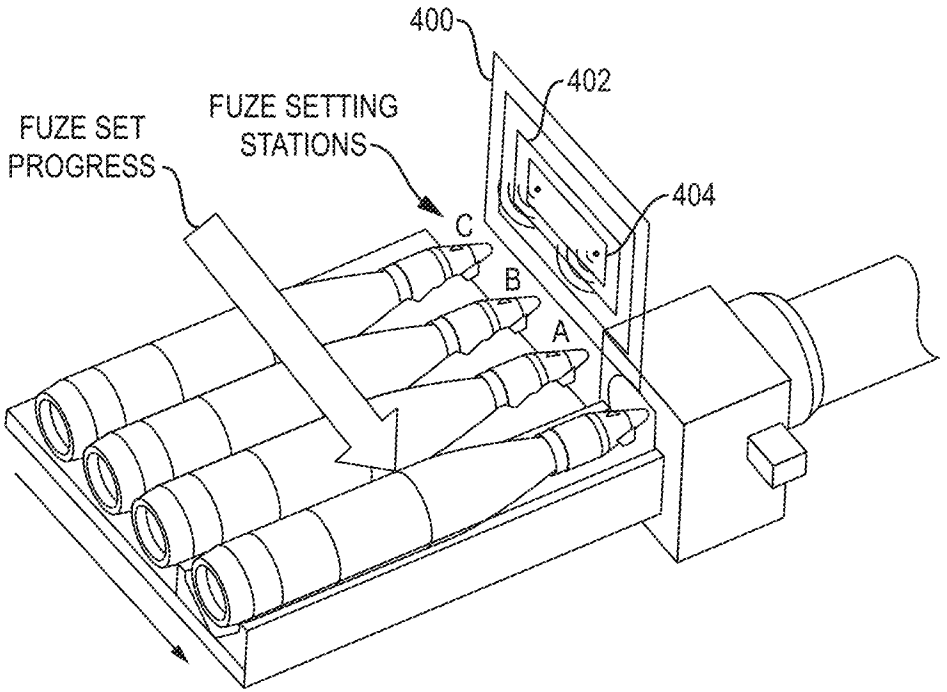
FIG. 4A is an illustration of a multi-fuze setting zone according to one embodiment.

In order to help reduce overall fuze setting time, the electrical energy transfer zone may extend across multiple fuzes, thereby allowing each fuze to be powered for a longer period of time. In extending the electrical energy transfer zone across multiple fuzes, each fuze has more time to boot up and initialize, undergo fuze setting, and report its status, without having to accomplish all of this in one cycle time of the autoloader. Thus and in accordance with an embodiment of the present disclosure, FIG. 4A shows a multi-fuze setting zone 400 that includes an electrical energy transfer zone 402 and a communications zone 404 in an oversized panel that extends across two or more PGM in close proximity to allow for the electrical and data transfers. The electrical energy transfer zone 402 may be extended over as many fuze setting stations as necessary in order to power the fuze for a sufficient amount of time to perform all requisite tasks prior to launch. This electrical energy transfer zone 402 includes an electrical energy transfer coil that provides electrical energy to the fuze. In one embodiment, the electrical energy transfer coil is inductive. In one embodiment, wireless electrical energy transfer occurs via magnetic resonance. Magnetic resonance can efficiently transfer high electrical energy while also overcoming efficiency drop resulting from the distance between the source of energy transmission and the receiving coils. Magnetic resonance is capable of transferring anywhere from less than 1 W to more than 1 kW across large air gaps. Additionally, magnetic resonance technology is scalable to fit the needs of a particular system. In another embodiment, wireless electrical energy transfer occurs via electromagnetic inductance.

Thus and in accordance with an embodiment of the present disclosure, the multi-fuze setting zone of FIG. 4A also includes a communications zone 404. This communications zone 404 includes a communications transceiver configured to transfer requisite fuze setting data to the fuze. The communications transceiver is capable of bidirectional communication. In one embodiment, the communications transceiver uses an antenna. In another embodiment, the communications transceiver uses an inductive coil. In one embodiment, the communications transceiver is configured to transfer Global Positioning System (GPS) Time Mark Pulses (TMP) to fuzes that utilize GPS-based navigation in order to synchronize GPS clocks in the fuze. GPS TMPs may be transferred across the air gap by modulating an inductive energy transfer signal in the fuze setter with the TMP. The fuze may then subsequently extract and decode the resulting pulses. In one embodiment, the communications zone uses a wireless RF communications link such as Bluetooth® or WiFi®. In another embodiment, the communications zone uses an inductive communications link such as near field magnetic induction (NFMI). NFMI provides high speed communication across relatively short air gaps with a steep drop-off in radiated signal strength compared to distance due to near-field operation. Therefore, NFMI presents a lower likelihood that signals potentially leak into the ambient environment and are subject to unwanted detection, thereby providing an inherent level of data security.

Figure 4B:
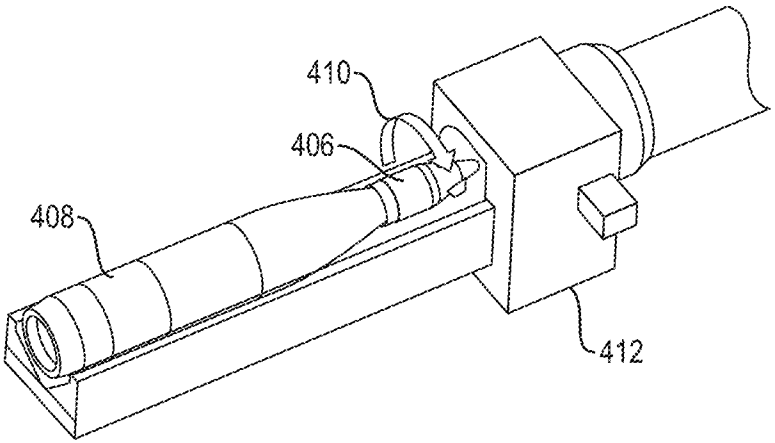
FIG. 4B is an illustration of rotationally decoupled fuze according to one embodiment.

FIG. 4B illustrates a fuze portion 406 that is rotationally decoupled from the projectile 408. Because it is rotationally decoupled, this allows the fuze 406 to spin freely about the longitudinal axis 410 of the projectile 408. As a result, the fuze rotational position is undefined relative to the fuze setting station 412. One advantage of wireless fuze setter interfaces is that the fuze does not have to be rotated into a particular, fixed orientation in order to align a connector on the fuze side of the interface to a mating connector on the fuze setter side of the interface as the wireless signals are agnostic to the rotational orientation of the fuze.

Figure 4C:
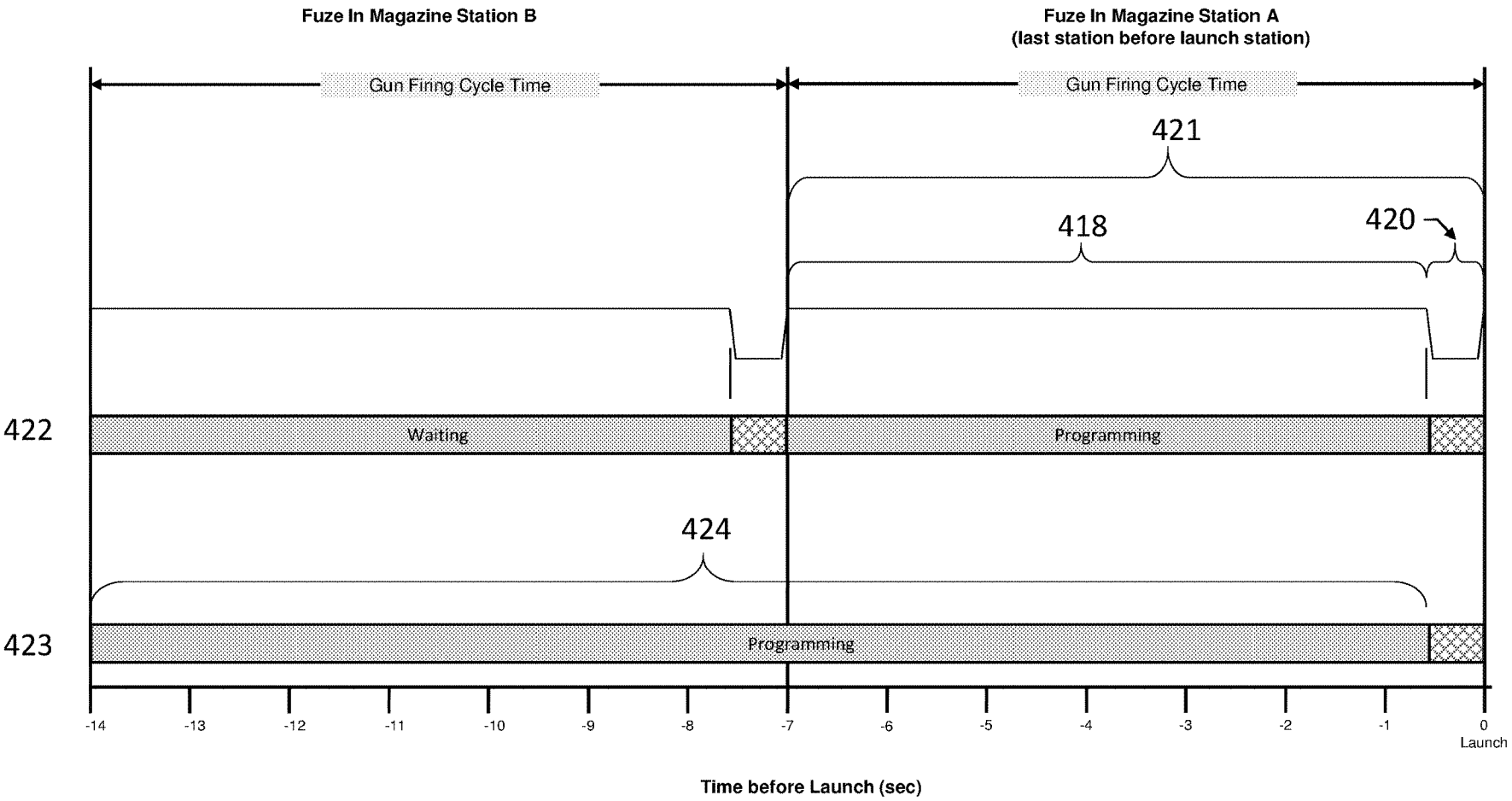
FIG. 4C is a graphical representation of the timing issue seen in traditional fuze setters.

FIG. 4C goes on to illustrate the timing issue seen in traditional fuze setter interfaces. In accordance with an embodiment of the present disclosure, a fuze programming zone can be created using wireless technology to extend across multiple autoloader magazine stations. This helps mitigate the issue of limited fuze setting time illustrated in FIG. 4C because the fuze programming zone effectively extends the time available to program each fuze. As a result, multiple fuzes that are in the programming zone can be programmed in a concurrent, pipelined manner. FIG. 4C depicts an embodiment of an autoloader 422 with a 7 second cycle time 421, within which there are about 6.5 seconds available for fuze setting within a single magazine station 418 and about 0.5 seconds to transfer the fuzed projectile to the next magazine station at the end of the current cycle 420. The overall time available for fuze setting in this example is constrained by the cycle time of the gun platform autoloader mechanism. By extending the programming zone to span multiple magazine stations, the overall programming time available 423 can be extended, thereby easing the time constraints associated with accomplishing the programming task before launch. In the FIG. 4C embodiment, the programming zone has been extended to span two magazine stations and effectively doubling the programming time 423. This increases the available fuze programming time to 13.5 seconds 424, extending over two full cycle times minus the time necessary to transfer the fuzed projectile to the next station 420. The aforementioned time values are representative only and provided as a non-limiting example. Specific autoloaders may have different cycle times. It should be appreciated that the fuze setter interface in this disclosure can span multiple fuzed projectiles.

Figure 5A:
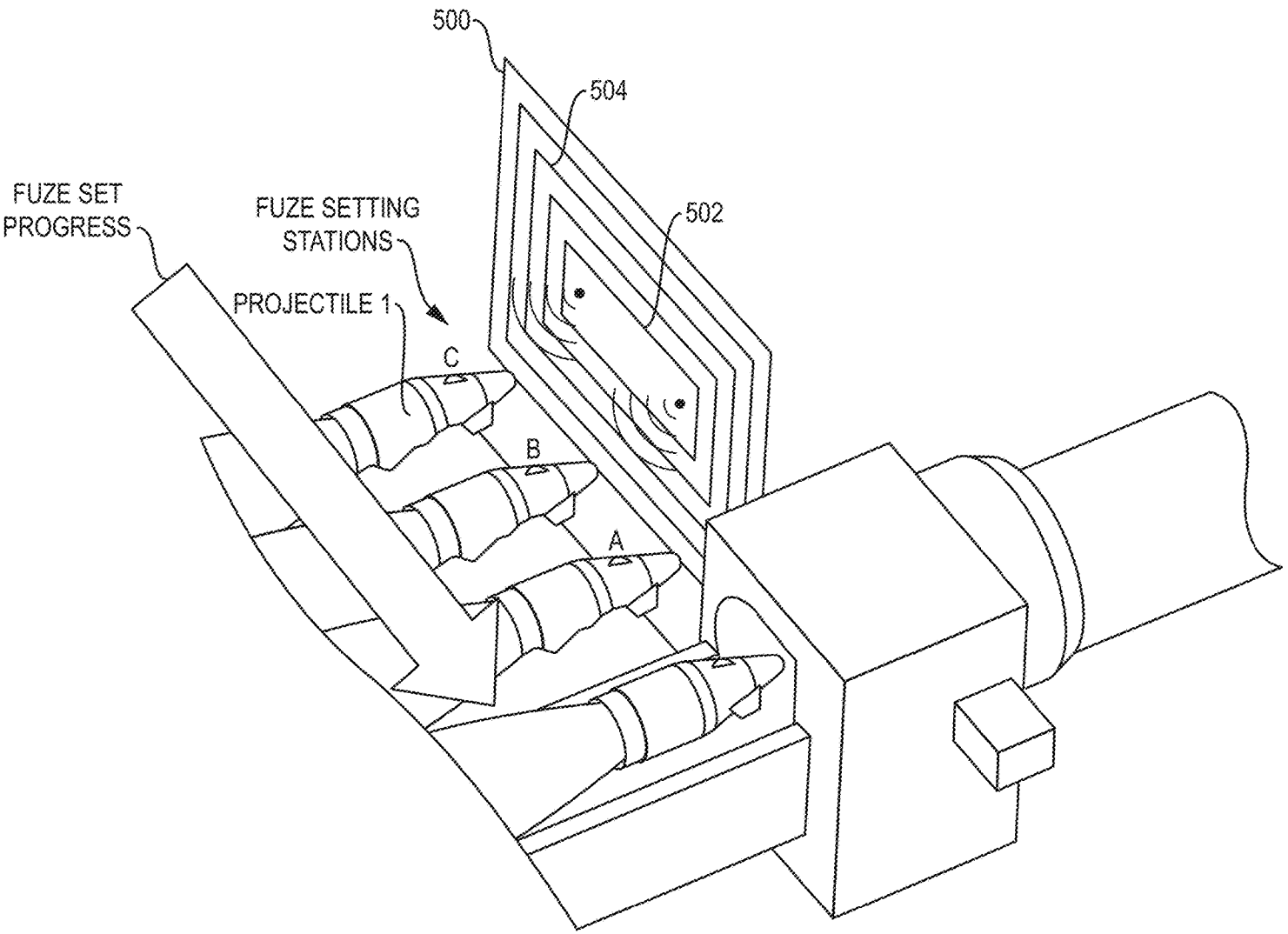
FIG. 5A is a close-up view of a multi-fuze setting zone according to one embodiment.
Figure 5B:
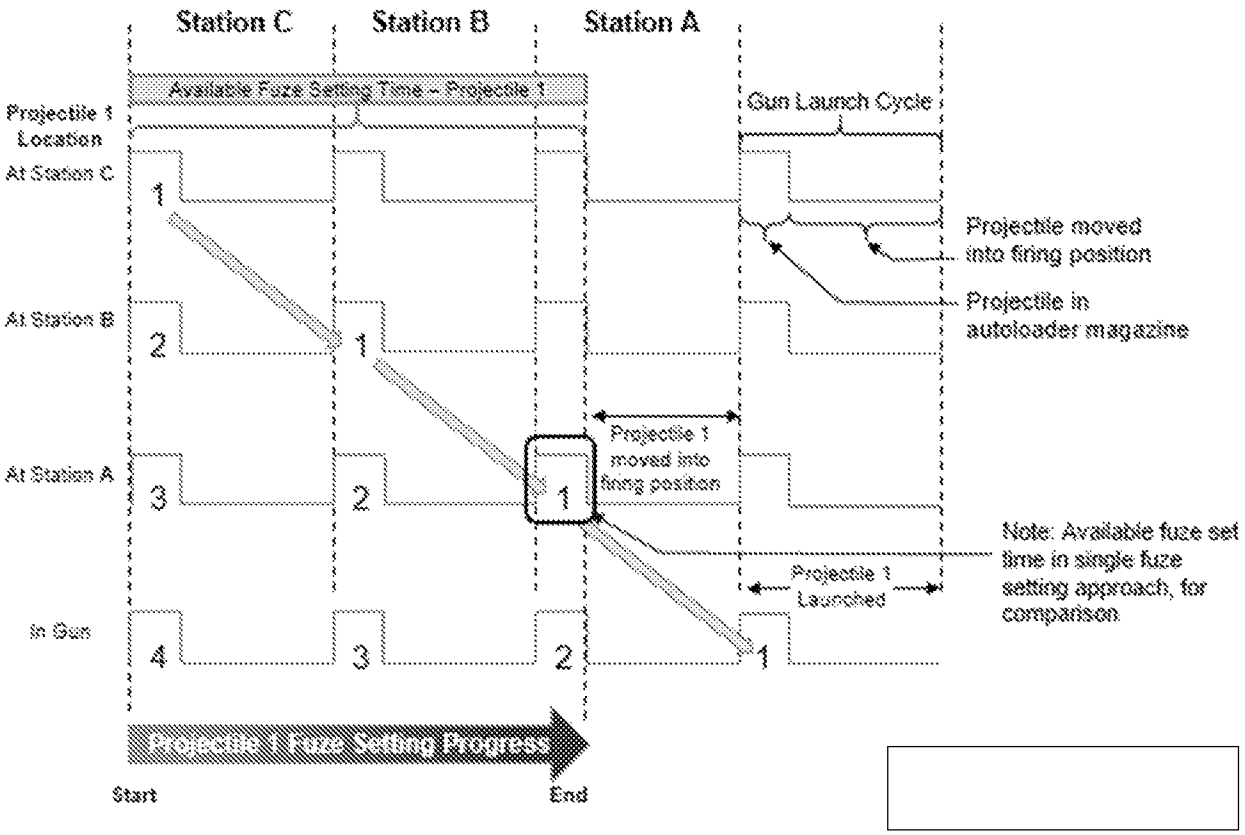
FIG. 5B is a graph illustrating fuze setting cycles according to one embodiment.
Figure 6A:
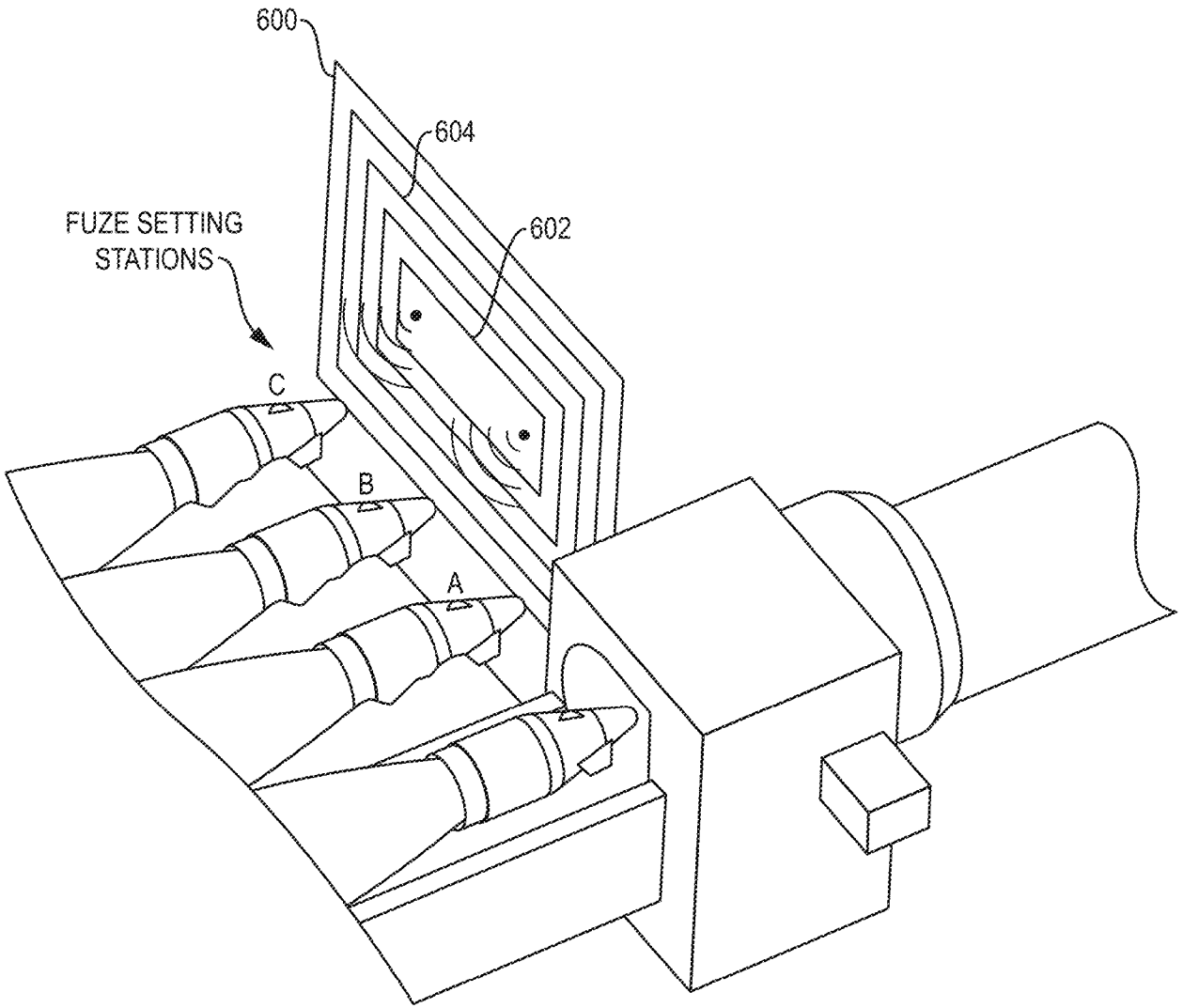
FIG. 6A is an illustration of a multi-fuze setting zone according to one embodiment.
Figure 6B:
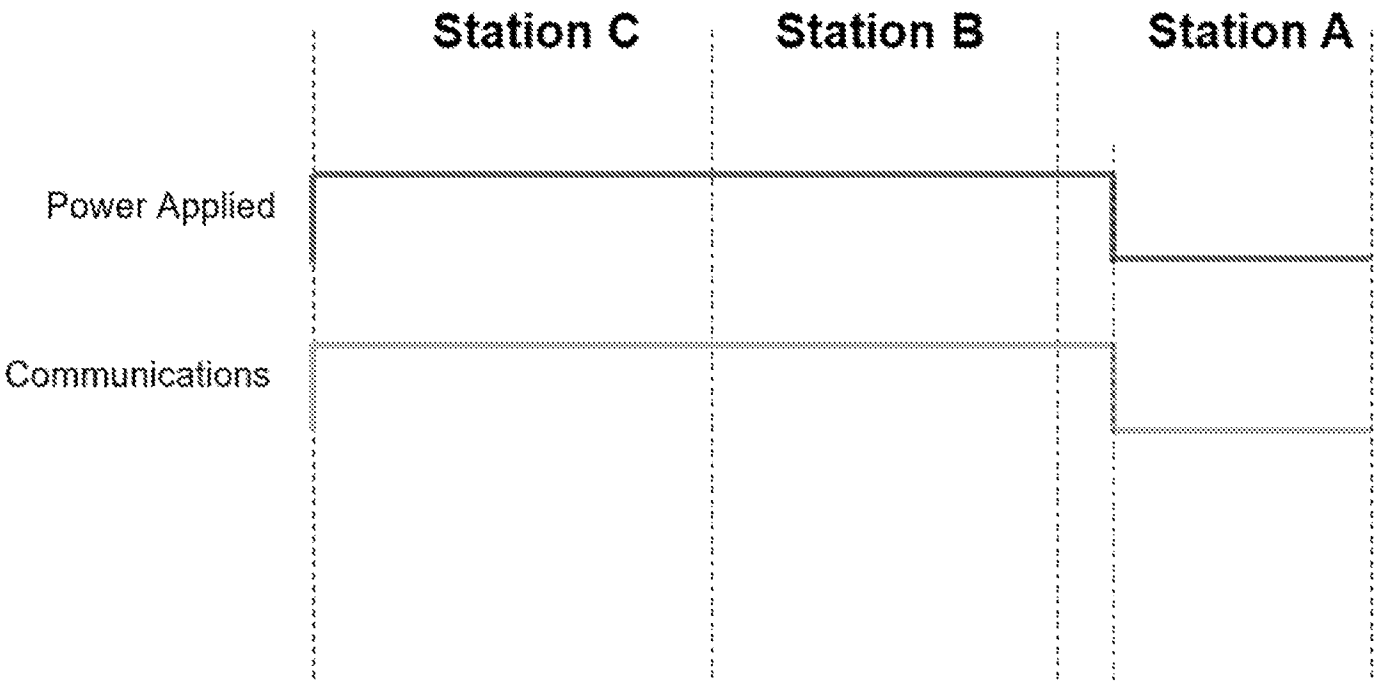
FIG. 6B is a graph illustrating electrical power being applied and communications occurring continuously across multiple autoloader stations during the fuze setting process according to one embodiment.

In accordance with an embodiment of the present disclosure, FIGS. 5A and 6A illustrate an extended fuze setting zone where the electrical energy transfer zone and communications zone overlap. This extended fuze setting zone allows fuze setting to occur in an uninterrupted manner across multiple fuze setting stations. For example, FIGS. 5B and 6B are timing illustrations that show a fuze setting zone 500, 600 that covers three fuze setting stations A, B, and C. For illustrative purposes, the following is an example for Projectile 1. Projectile 1, which has a fuze (fuzed projectile), will enter the fuze setting zone at Station C to begin the fuze setting process. In one embodiment, the fuzed Projectile 1 will move to the next Station B in the time it takes for one full gun firing cycle. In the example shown in FIG. 5B, the extended fuze setting zone has increased the available fuze setting time from only about 25% of a single gun firing cycle to two full gun-firing cycles while at Stations C and B in addition to the same 25% of the last cycle before the fuzed projectile is moved into firing position. The 25% value is an estimate, and represents a minimum time consistent with achieving a high autoloader cycle rate. While this value could be increased to possibly as much as 60-80% of a single gun firing cycle, it would not achieve 100% (see FIG. 4C) since some of the time within a cycle will be dedicated to moving the fuzed projectile to the next autoloader fuze setting station. FIGS. 5A and 6A show a communications zone 502, 602 and an energy transfer zone 504, 604 that extend across multiple fuze setting stations, thereby powering a fuze and communicating with it continuously from the moment it enters the fuze setting zone until it leaves the last setting station just prior to launch. As a result, there is no need to interrupt power or communications as each fuzed projectile moves from one station to the next, allowing use of the entire and multiple cycle times for fuze setting. It should be recognized that while the power and communications is made available to the fuzed projectile, the fuzed projectile will only use the requisite power and data.

Figure 7A:
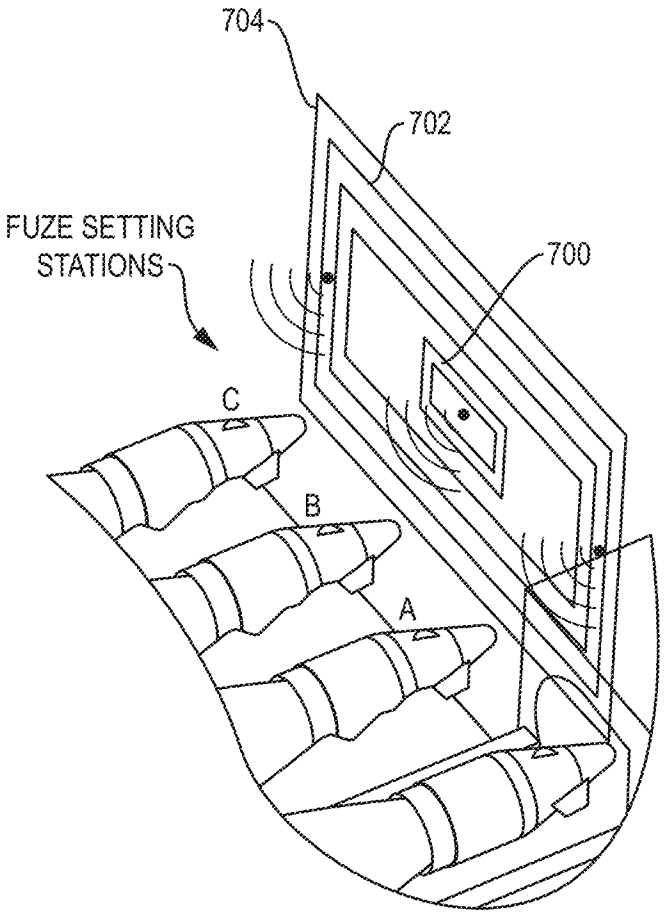
FIG. 7A is an illustration of a multi-fuze setting zone with an extended electrical energy transfer zone according to one embodiment.
Figure 7B:
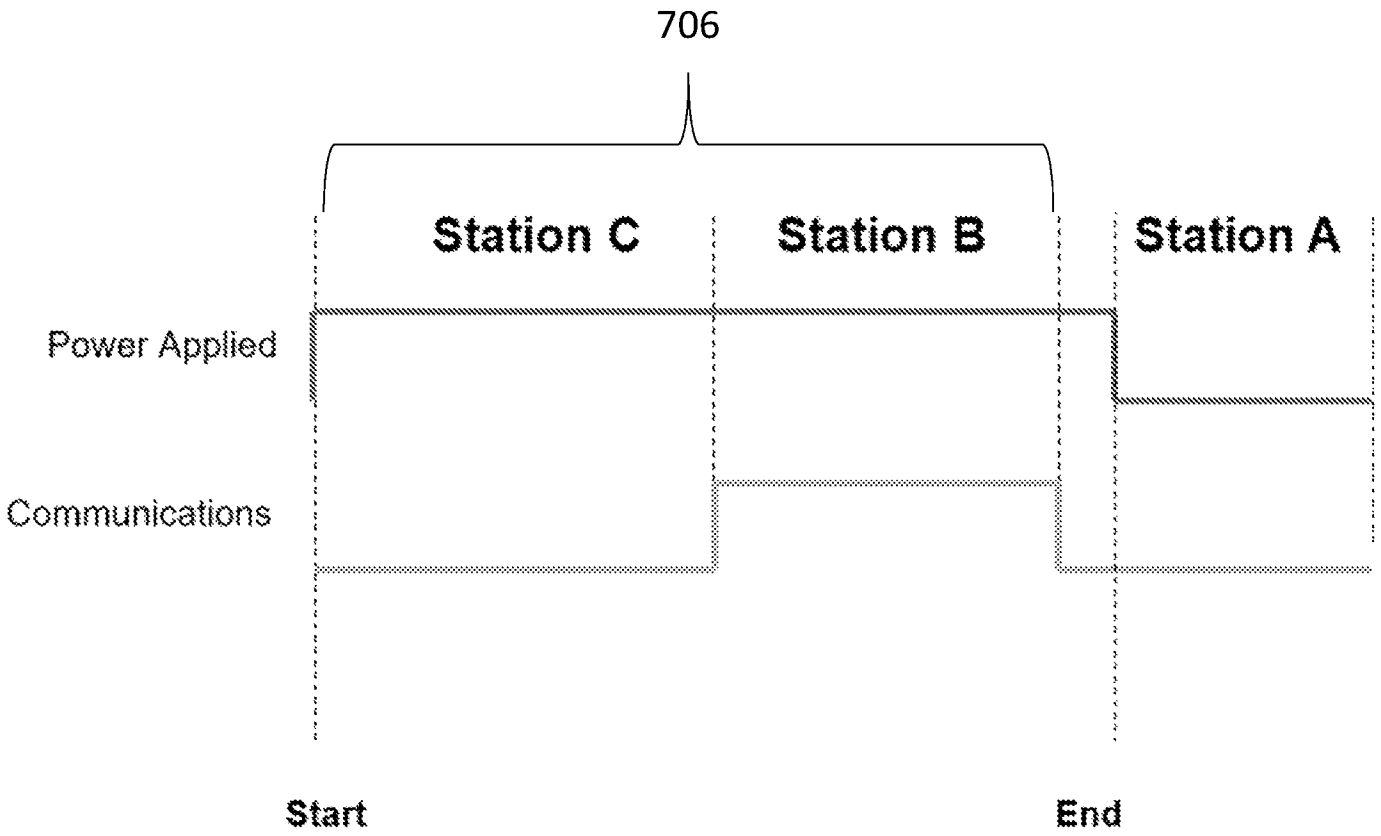
FIG. 7B is a graph illustrating an electrical energy transfer zone extending beyond the communications zone according to one embodiment.

In accordance with an embodiment of the present disclosure, FIGS. 7A and 7B illustrate a fuze setting zone where the communications zone 700 is limited to a single setting station within a larger electrical energy transfer zone 702, such that the fuze enters the electrical energy transfer zone 702 before entering the communications zone 700. Because the electrical energy transfer zone 702 extends beyond the communications zone 700, this configuration allows the fuze more time to boot up, initialize, and perform any requisite functional checks prior to needing to initiate fuze setting communications. In doing so, this allows the fuze time to perform certain startup tasks before it becomes necessary to establish fuze setter communications prior to launch. FIG. 7B illustrates a graphical representation of the fuze setting process seen in the multi-fuze setting zone of FIG. 7A. When a fuzed projectile enters Station C of the multi-fuze setting zone 704 as depicted in FIG. 7A, it first enters the electrical energy transfer zone 702 in FIG. 7A. The electrical energy transfer zone 702 applies power to the fuze while it is in Stations C and B 706. As the fuzed projectile then moves to Station B, it enters the communications zone 700. Here, the communications zone 700 transfers the data required to properly configure the fuze for launch. As the fuzed projectile then progresses to Station A, the level of power and data applied to the fuze decreases as it prepares to enter the feed tray for the launcher.

Figure 8:
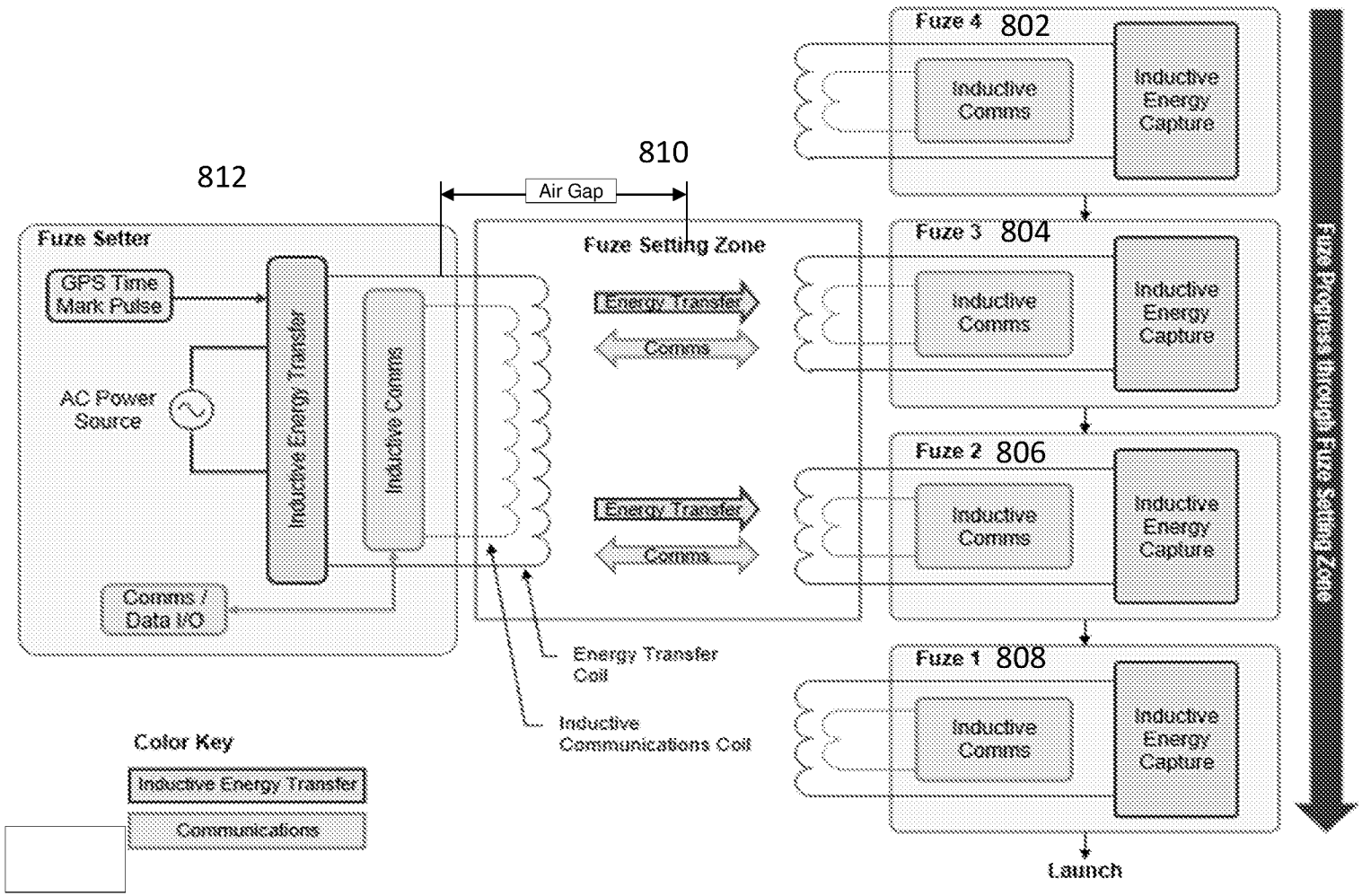
FIG. 8 is a high level overview of the topology of an inductive fuze setter interface according to one embodiment.

FIG. 8 is a high level overview of the topology of an inductive wireless fuze setter interface in accordance with an embodiment of the present disclosure. In one embodiment, an inductive communications link is implemented. GPS Time Mark Pulses (TMP) are transferred across the air gap 800 seen in FIG. 8. This is accomplished by modulating the inductive energy transfer signal in the fuze setter with the TMP. The fuze can then subsequently extract and decode these pulses. In another embodiment, a wireless RF communications link such as Bluetooth® or WiFi® is implemented instead of an inductive communications link. Such communications can be encrypted or otherwise secure depending upon the ability of the fuze. As depicted in FIG. 8, there are four fuzes 802, 804, 806, 808 in the queue. In this example, Fuze 4 802 has not yet entered the fuze setting zone 810. Fuze 4 802 is unpowered and unset. Fuzes 3 and 2 804, 806 are in the fuze setting zone 810.

As illustrated in FIG. 8, Fuze 3 804 receives energy from the fuze setter 812 and powers up. The fuze setter 812 in turn discovers, identifies, and establishes a connection with Fuze 3 804. Fuze setting for Fuze 3 804 begins while the fuze setting process for Fuse 2 806 is already underway. Fuze 2 806 occupies the final station before the launch as the fuze setter completes the setting of Fuze 2 806. Fuze setting of Fuze 2 806 continues to completion, and fuze setter status is reported back to the fuze setter. Fuze 1 808 has been fully set and, as seen in FIG. 8, has progressed beyond the fuze setting zone in preparation for launch. Fuze 1 808 is now internally powered and awaiting launch. The energy acquired during the fuze setting process is what internally powers Fuze 1 808 as it awaits launch. In other embodiments, a different internal power source other than the energy acquired from fuze setting may be used to internally power the fuze. In one embodiment, an alternative internal power source is a lithium battery.

Generally, the fuze setter must be able to electrically power the fuze during the fuze setting process. Additionally, the fuze may be capable of storing additional electrical energy to help power the fuze through launch after the fuze setter has been disconnected. In order to help reduce the overall fuze setting time, high electrical power is necessary to transfer the requisite energy in as short a time as possible. The conventional approach in the prior art has been to utilize electromagnetic induction for energy transfer. However, this approach has certain drawbacks. Electromagnetic induction produces a lower efficiency power transfer compared to magnetic resonance as seen in the present disclosure. Additionally, electromagnetic induction can only efficiently and effectively transfer power over a small air gap (approximately 3 cm). This limitation on the transfer distance means that transfer efficiency decreases as the air gap between the power transmission and reception coils in the fuze and fuze setter increases.

Figure 9:
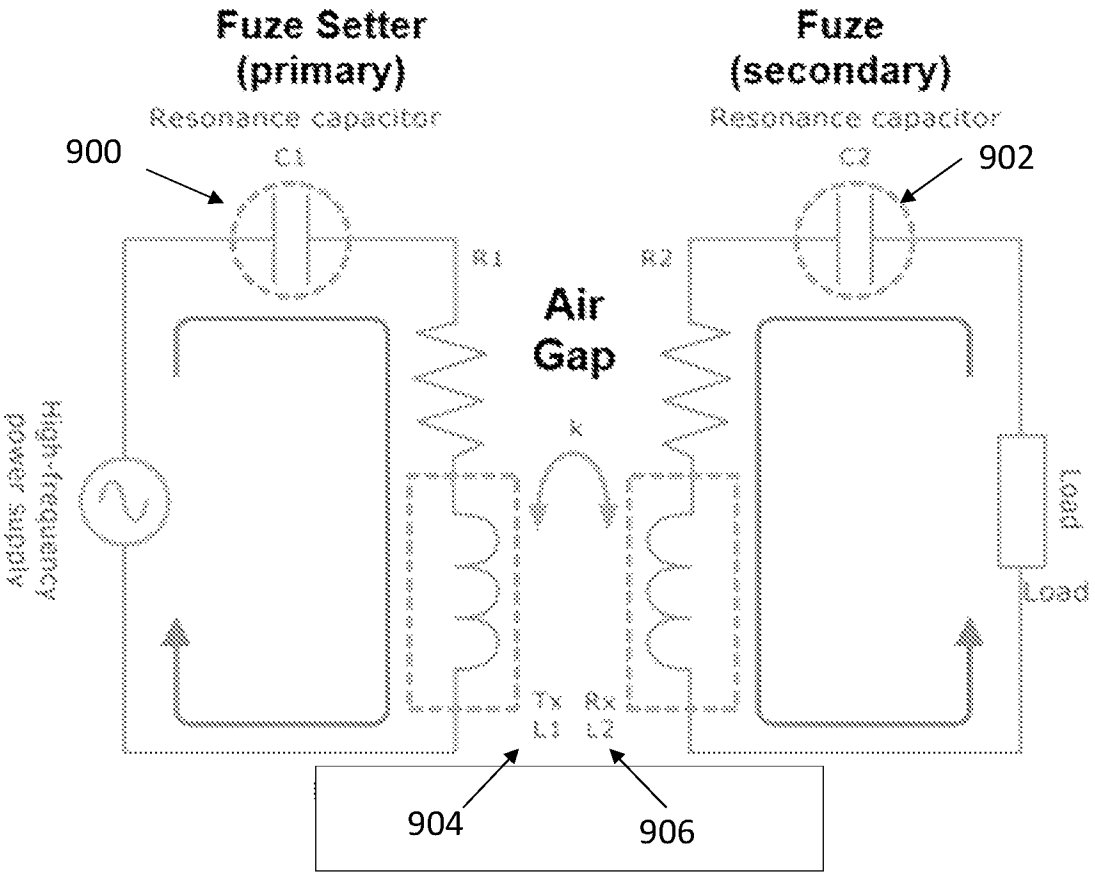
FIG. 9 is an illustration of the basic principle of a magnetic resonance method of power transfer according to one embodiment.

In contrast, magnetic resonance wireless energy transfer can overcome the drawbacks seen with electromagnetic induction energy transfer. Unlike electromagnetic induction, magnetic resonance can more efficiently transfer high amounts of energy during fuze setting. As a result, this means that energy can be transferred across the interface with minimal energy loss. Additionally, magnetic resonance does not require close proximity between the power transmission and reception coils of the fuze and fuze setter in order to transfer electrical energy. Rather, magnetic resonance can transfer electrical energy across larger air gaps without loss in efficiency. As illustrated in FIG. 9, this is accomplished by inserting a capacitor on the power transmission side 900 and a capacitor on the power reception sides 902 in order to form an LC (inductor and capacitor) resonant circuit with corresponding inductors 904, 906. Power is then transferred by matching the resonance frequencies on both sides. This magnetic resonance approach operates by forming an air core transformer as illustrated in FIG. 9. This transformer is comprised of a driving coil L1 904 on the fuze setter (primary side) and a driven coil L2 906 on the fuze (secondary side). The primary side's LC tank circuit (C1, L1) 900, 904 is driven by an AC input waveform at a tank resonant frequency. A secondary side tank circuit within the fuze (L2, C2) 902, 906 operates at the same frequency as the primary side. Because the two sides are operating at a common resonant frequency, a high power transfer efficiency is achieved between the primary and secondary coils across a relatively large air gap. This air gap may exceed several inches.

Figure 10A:
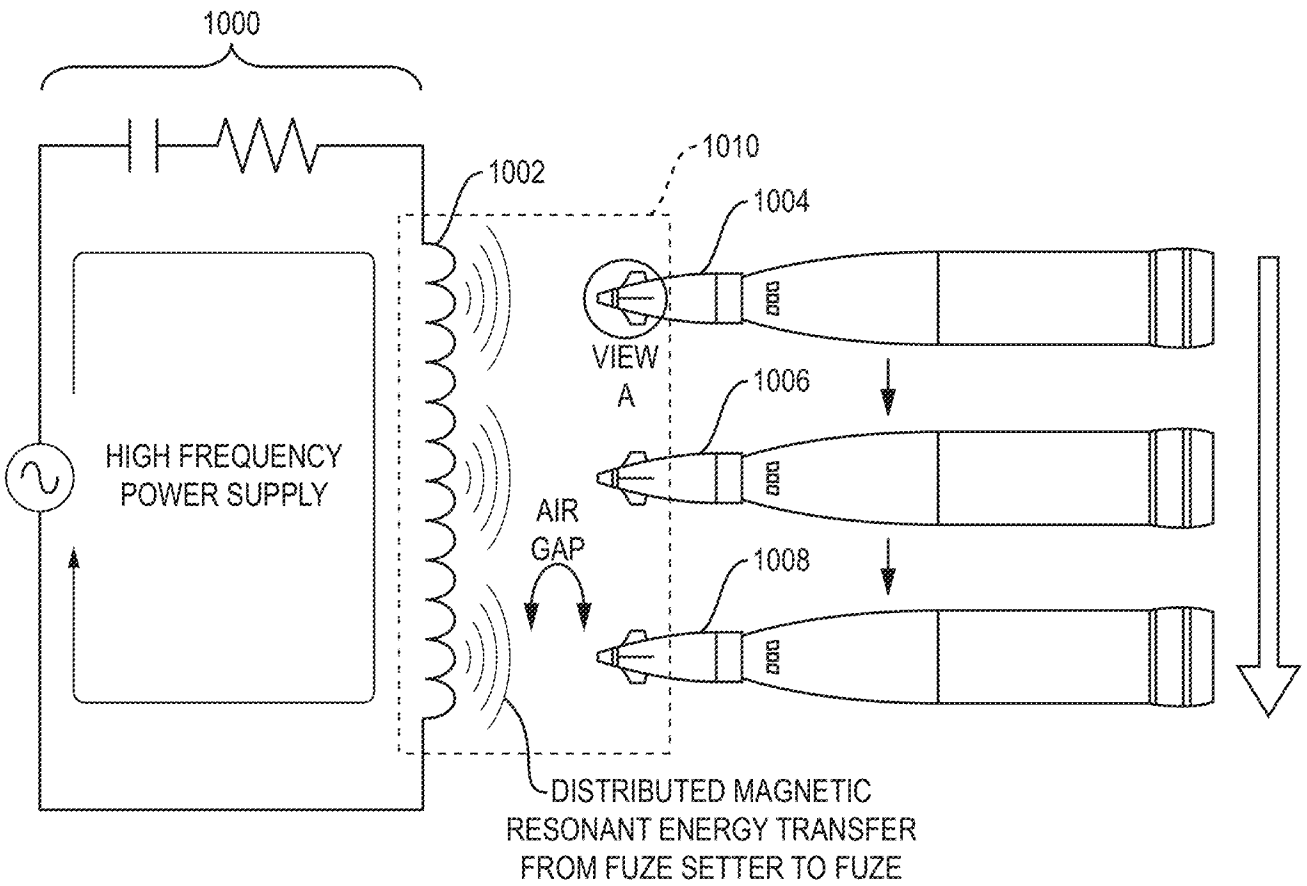
FIG. 10A is an illustration of a magnetic resonant energy transfer approach according to one embodiment.
Figure 10B:
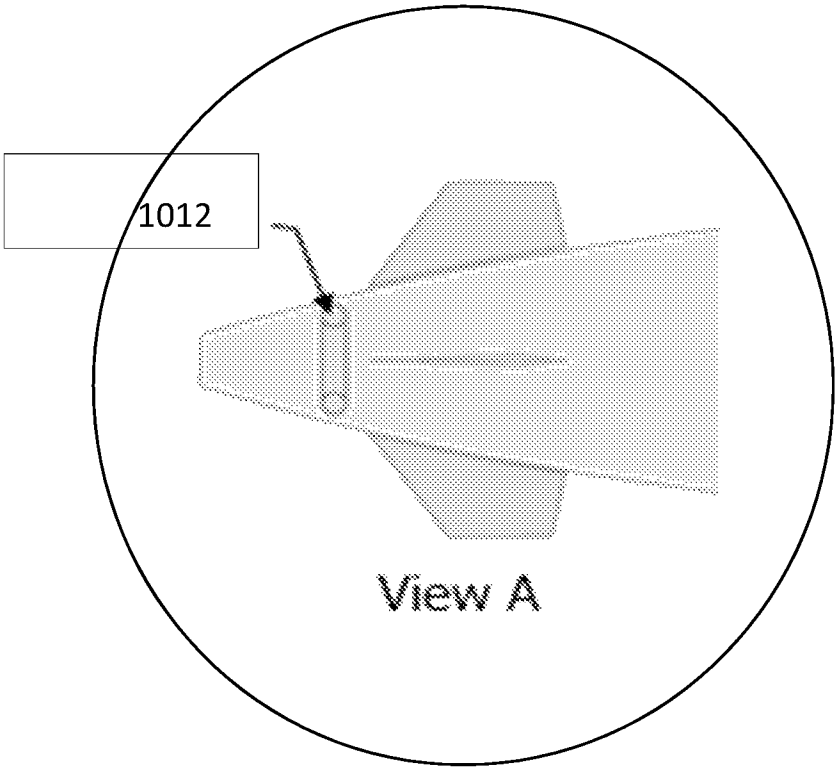
FIG. 10B is a closer view of the fuze seen in FIG. 10A according to one embodiment.

Therefore in accordance with an embodiment of the present disclosure, FIG. 10A is an illustration of a fuze setter implementation that uses magnetic resonant energy transfer in accordance with an embodiment of the present disclosure. In one embodiment, the fuze setter 1000 has fuze setter energy transmission coils 1002 that are configured to transfer energy to the fuzes 1004, 1006, 1008 on the projectiles via magnetic resonant energy transfer within the fuze setting zone 1010. To accomplish magnetic resonance, a capacitor is inserted into the power transmission side as well as the power reception side in order to form a LC resonance circuit. Power can then be transferred between the fuze setter side 1002 and the fuze side 1004, 1006, 1008 based on matching their respective resonance frequencies. Magnetic resonance has several advantages compared to conventional electromagnetic induction. Magnetic resonance wireless power transfer presents a minimal drop in transfer efficiency because of distance between the coils. As a result, magnetic resonant energy transfer can accomplish high power transfer (from <1 W to >1 kW) across relatively large air gaps. Additionally, magnetic resonant energy transfer is a scalable technology that can also support transmission of discrete signal data such as GPS TMP transmission. As seen in FIG. 10B, View A shows an exploded view of the tip of the fuze that contains a fuze energy reception coil 1012, which receives the energy from the fuze setter. As the various fuzes progress through the fuze setting zone to the launch station, energy is continuously transferred to them.

In order to properly program fuzes prior to launch, fuze setters must transfer large amounts of data to fuzes of PGMs. As previously discussed, this large amount of data may exceed the launch cycle time that is available. As a result, there is a need for high speed wireless data transfer between the fuze setter and fuze. One such approach involves utilizing Near Field Magnetic Induction (NFMI). NFMI communication is based on the principle of resonant inductive coupling (RIC). RIC involves two matched coils, each coil forming its own LC circuit with the same resonance frequency. NFMI communication modulates the magnetic field and forms the bases of near-field communications (NFCs) among NFMI devices. As a result, because the electric field plays no role in the communication, the signal is almost purely magnetic and therefore does not suffer from the usual fading and diffraction associated with electromagnetic waves.

Additionally, NFMI provides high speed communication capabilities across relatively short air gaps with an inherent steep fall-off in radiated signal strength. This ultimately minimizes the possibility of signal leakage, where transmitted data leaks into the ambient, surrounding environment. From a data security perspective, data leakage is problematic because it creates an opportunity for possible detection by a hostile actor out in the field (i.e. eavesdropping). NFMI communication addresses this potential data security problem with a steep drop-off in signal strength in the far-field. More specifically, within the near-field (as defined by the carrier signal wavelength), the received power falls off as $1/r^6$ of the distance r, rather than $1/r^2$ for far-field communications based on RF wireless communication, further discussed below. Because of this steep drop-off, NFMI communications are far less susceptible to eavesdropping than RF wireless communication. Another wireless data transfer approach uses RF wireless technologies such as Bluetooth® and Wi-Fi®. RF wireless technologies not only provide high communication speeds but also are capable of operating in far-field environments over larger distances than NFMI. However, this longer range capability may not be ideal for an autoloader application where data security is an important consideration.

Figure 11:
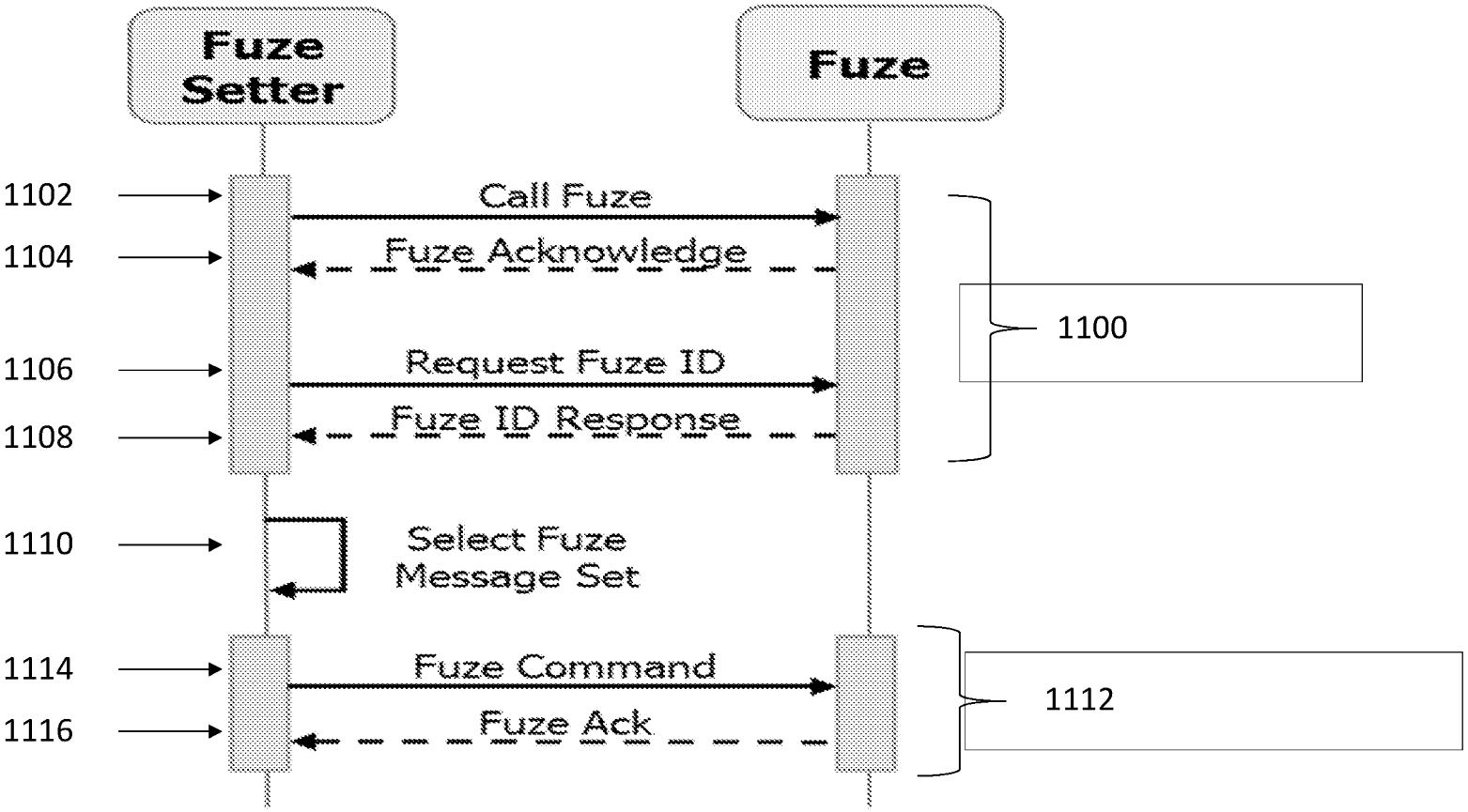
FIG. 11 is a diagram depicting the process for detecting that a fuze is present within the programming zone and establishing communications between the fuze setter and the fuze according to one embodiment.

FIG. 11 is a diagram depicting the process for detecting that a fuze is present within the programming zone and establishing communications between the fuze setter and the fuze. FIG. 11 also depicts identifying the type of fuze and selecting the appropriate message set to be used to communicate with the fuze, which is based on the fuze type. It should be noted that messages within a message set may contain data elements specific to a fuze type that will be communicated to the fuze during the fuze setting process. This architecture allows the customization and tailoring of message sets to different fuze types. This ability to accommodate different fuze types can also be seen in FIG. 3 above. FIG. 12 below illustrates various state transitions during the identification process seen in FIG. 11.

In accordance with FIG. 11, the fuze setter first attempts to contact the fuze by using a message protocol for fuze identification 1100. This message protocol 1100 is common to fuze types recognized by the system. First, the fuze setter calls the fuze 1102. The fuze will then acknowledge and respond 1104 and, upon request by the fuze setter 1106, provide a fuze identification message to the setter 1108. After the fuze setter determines and identifies the type of fuze, the fuze setter will then select the relevant setting messages for that particular fuze and use these to set the fuze 1110. During fuze setting 1112, which is a fuze-specific protocol, the fuze setter will send these messages to the fuze 1114, and in turn the fuze will send back an acknowledgement of receipt 1116.

Figure 12A:
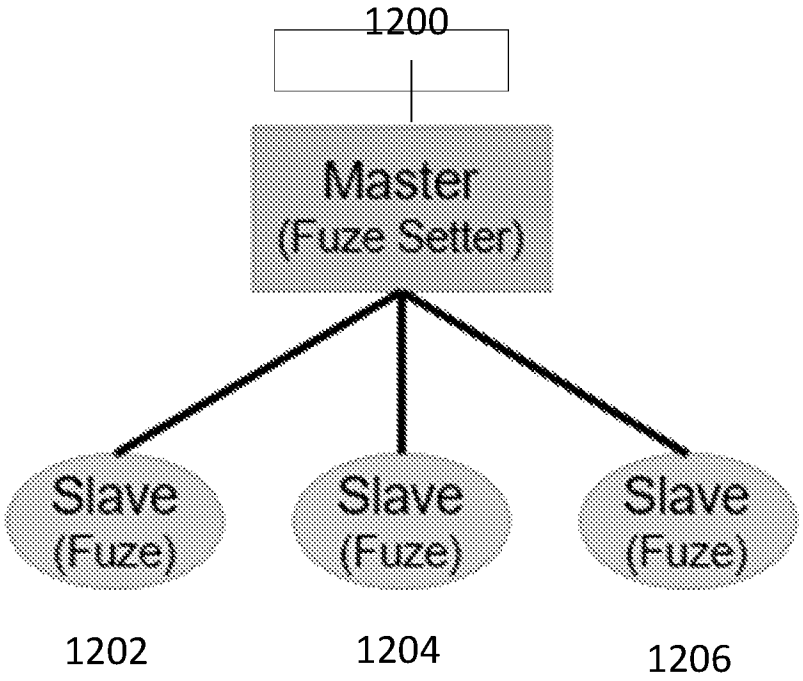
FIG. 12A is a diagram illustrating a basic network topology according to one embodiment.

FIG. 12A is a diagram illustrating a communications network topology in accordance with an embodiment of the present disclosure. Generally, the communications network topology may be represented by the fuze setter functioning as a Master device 1200 and one or more fuzes acting as Slave devices 1202, 1204, 1206. The Master device 1200 establishes a connection to one or more Slave devices 1202, 1204, 1206 using a commonly understood protocol. In one embodiment for illustrative purposes, this protocol is similar to Bluetooth® processing. Each Master device/Slave device pairing has a unique N-bit address. This will usually be presented in the form of an M-digit hexadecimal value. The most significant half (N/2 bits) of the address may be an Organization Unique Identifier (OUI). The OUI can be used to identify the device family or other device group information. The lower N/2 bits represent the unique part of the address. The actual communications mechanism can be magnetic inductive or otherwise wireless based.

Figure 12B:
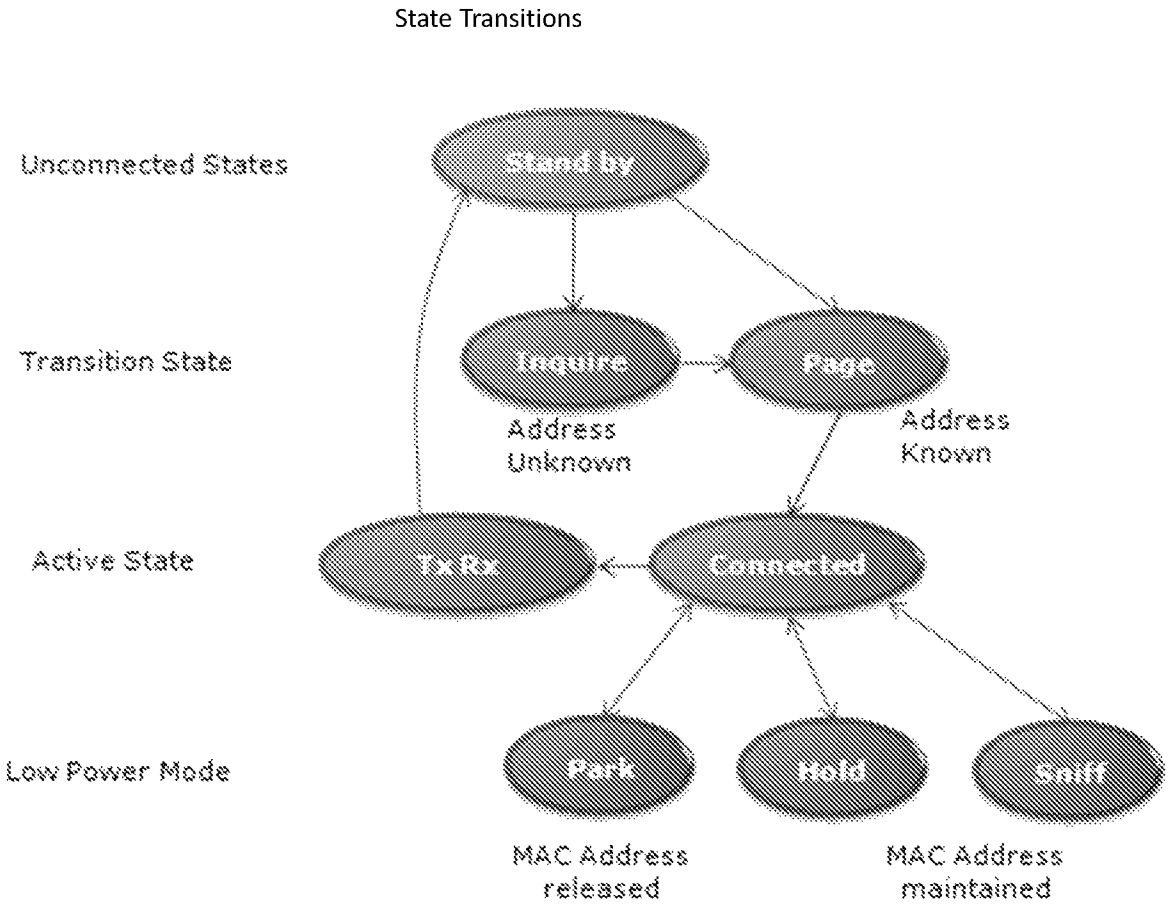
FIG. 12B is a diagram illustrating a fuze identification protocol and state transitions according to one embodiment.

FIG. 12B is a diagram of the various state transitions involved in the connection process for the communications network topology. In accordance with an embodiment of the present disclosure, at the Inquire state, the Master device runs an inquiry to discover other Slave devices. In one embodiment, the Master device sends out an inquiry request, and any Slave device listening for such a request will accordingly respond with its address. It may also respond with its name and other information. At the Paging/Connecting state, paging is the process of forming a connection between two devices. However, before this connection can be initiated, each device needs to know the address of the other. This information is obtained during the previously discussed Inquiry state. After a device has completed the Paging/Connecting process, the device then enters the Connection state. Here, while the device is connected, it can either be actively participating or it can be placed into a low power sleep mode. In one embodiment, the device may enter Active Mode, which is the regular connected mode. Here, the device is either actively transmitting or receiving data. In one embodiment, the device may enter Sniff Mode, which is a power-saving mode. Here, the device is less active and will only listen for transmissions at a set internal such as every 100 ms. In another embodiment, the device may enter Hold Mode, which is a temporary, power-saving mode. Here, the device sleeps for a defined period of time and then returns back to Active Mode when that defined period of time has passed. The Master device can command a Slave device to hold. In another embodiment, the device may enter Park Mode, which is the deepest of the various sleep modes. Here, a Master device can command a Slave device to "park," and that Slave device will become inactive until the Master device tells it to wake back up.

Figure 13:
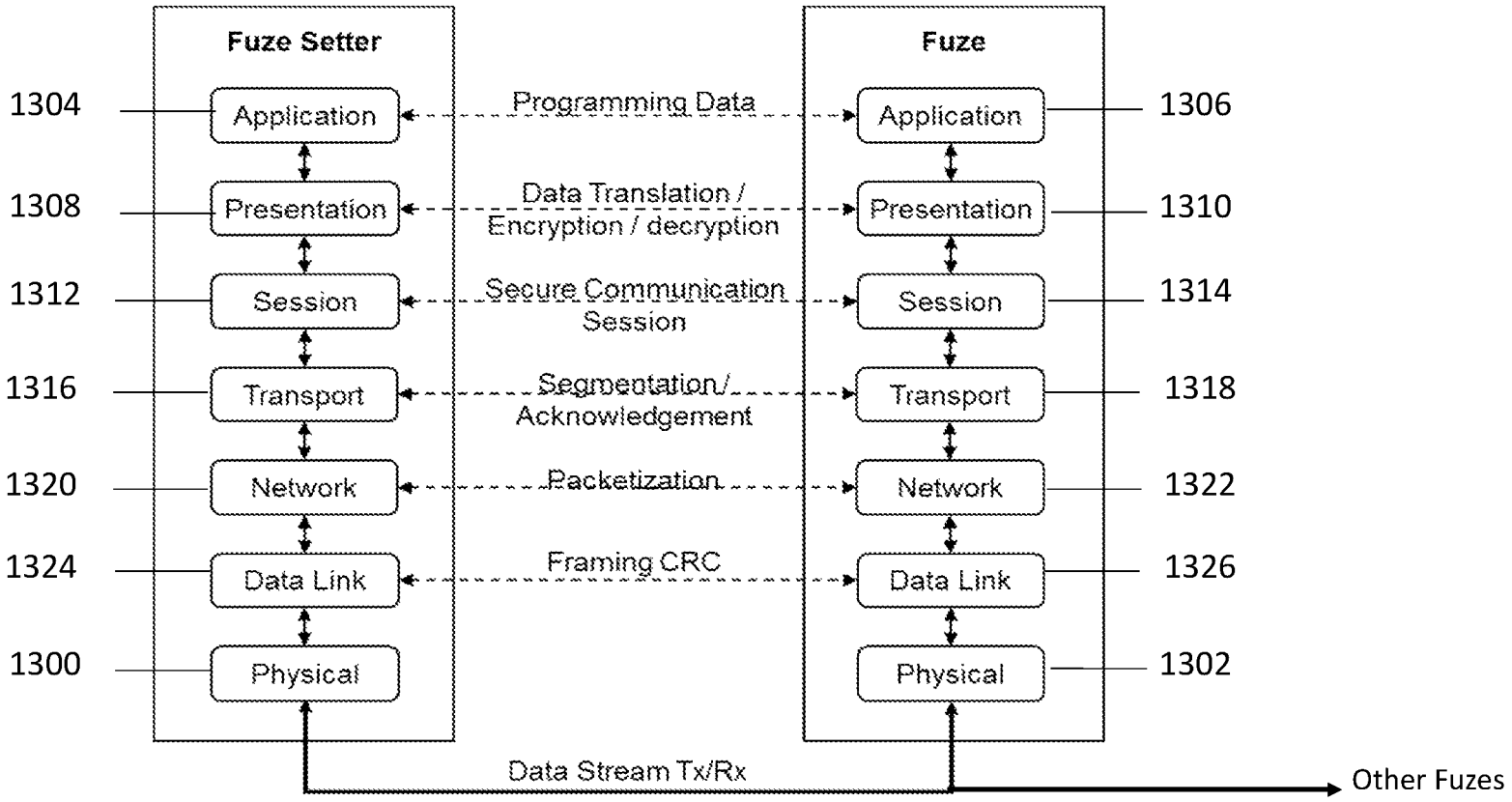
FIG. 13 is diagram illustrating a fuze setter Open Systems Interconnection (OSI) model for the software communication architecture according to one embodiment.

FIG. 13 is a diagrammatic representation of an Open Systems Interconnection (OSI) approach to software architecture in accordance with an embodiment of the present disclosure. While the non-limiting embodiment shown in FIG. 13 features one fuze, a significant advantage of the approach discussed further below is that multiple fuzes can be networked, thereby allowing concurrent programming by a single fuze setter so that multiple fuzes may be networked. The OSI approach divides each communicating device's software into multiple layers. These layers are what allow the communicating devices to communicate with each other horizontally. From a vertical perspective, each layer provides services to its parent layer(s) and receives required services from lower, child layer(s). As seen in FIG. 13, the only actual connection between the fuze setter and fuze is the bottom level where the respective physical layers 1300, 1302 interact. The physical layer 1300, 1302 handles communication at the data stream level while detecting and correcting any errors where the data is just a bitstream. In one embodiment, the data stream connection is implemented as a wireless connect interface. In another embodiment, the data stream connection is implemented as a direct connect interface.

In accordance with an embodiment of the present disclosure, FIG. 13 implements the Open Systems Interconnect (OSI) model for data communication across a network. The network is formed by multiple interconnected nodes which are represented by the fuze setter and one or more fuzes to be programmed in various embodiments. Data to be communicated from the fuze setter to one or more fuzes or vice versa, is first packaged at the Application layer 1304, 1306 as seen in FIG. 13. This data package is then passed down to the Presentation layer 1308, 1310 for formatting and encryption as necessary before passing down to the Session layer 1312, 1314 where secure communication headers are attached and a session or connection between fuze and fuze setter is established and managed. Session layer services can also include authorization, authentication and reconnection. The Transport layer 1316, 1318 manages the delivery of data packets, performs error checking, and generally manages the flow of data. The Network layer 1320, 1322 acts as a network controller, responsible for determining the physical path that the data will take based on logical addresses contained within the data packets, and ensuring that each data packet is transmitted to the correct destination. The Data Link layer 1324, 1326 transfers data packets between directly connected nodes and ensures that received data is error free. As the data package travels vertically downward to the Physical layer 1300, 1302 it receives additional information at each layer that the corresponding layer on the receiving side can subsequently interpret and process. When the data package is ultimately transmitted to the other side of the interface (e.g. from fuze setter to fuze, and vice versa), the received data package starts at the Physical layer 1300, 1302 before traveling vertically upward through each layer for further processing. This OSI approach provides several advantages. Each layer can be implemented as a software module. This allows each layer to have defined interfaces with the layers above and below. The OSI approach allows for both modularity and reuse by maintaining loose coupling between the various modules. This approach also allows for configurability by enabling the addition or removal of corresponding layers from both the fuze setter and the fuze in order to create more or less security, correct errors, etc. Additionally, the OSI approach creates the potential that, on the fuze side, only the application layer would need further customization depending on the fuze type.

Figure 14:
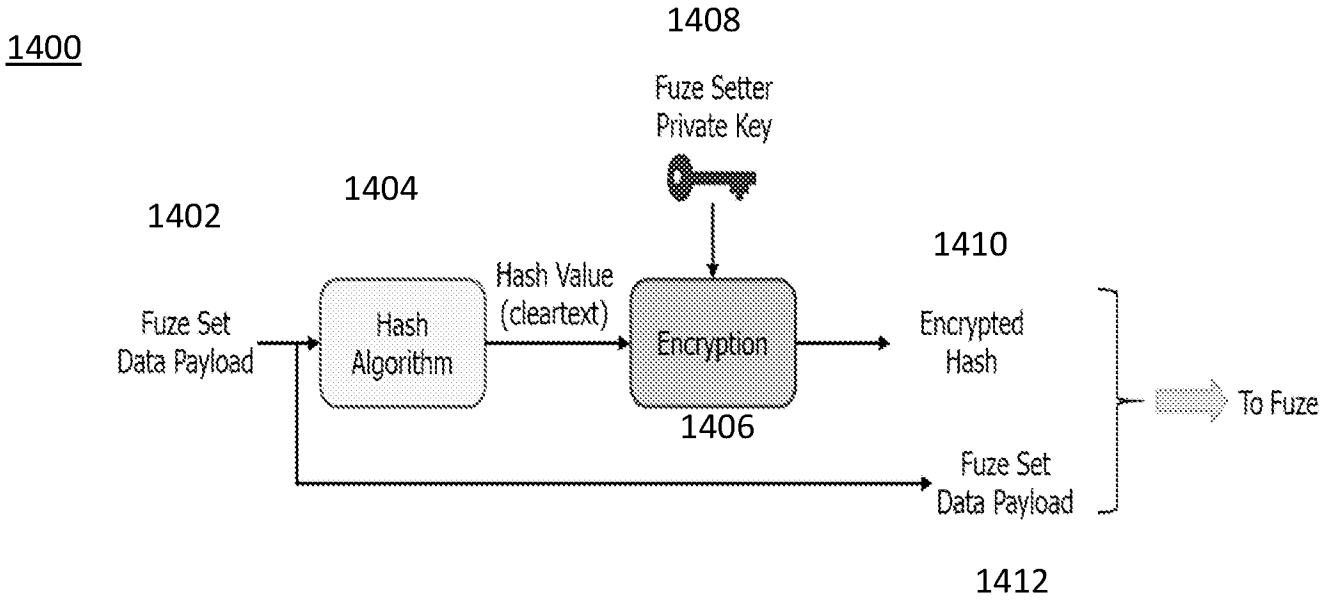
FIG. 14 is a diagram showing use of public/private key cryptography for cybersecurity according to one embodiment.
Figure 15:
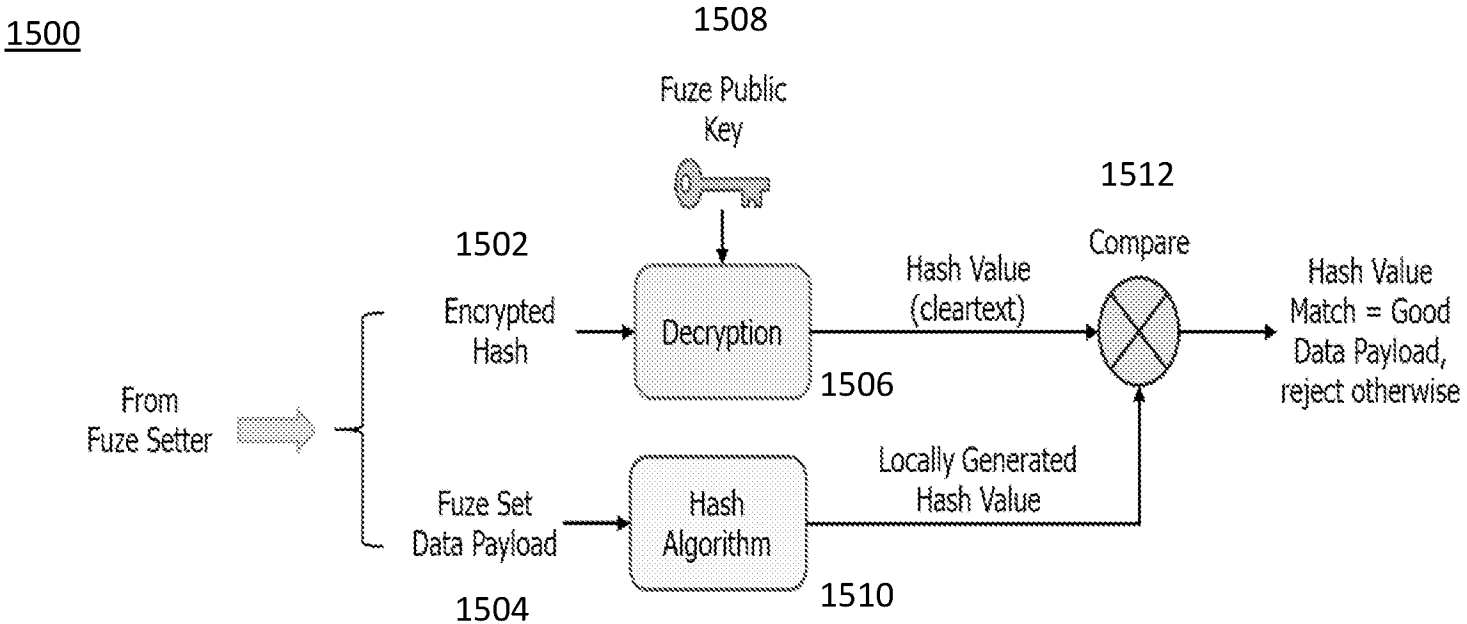
FIG. 15 is another diagram showing use of public/private key cryptography for cybersecurity according to one embodiment.

From a cybersecurity perspective, the fuze setter interface of the present disclosure can implement a variety of cybersecurity features depending on the nature of actual and anticipated threats. FIGS. 14 and 15 show how public/private key cryptography may be used to provide security. Public/private key cryptography allows the fuze to verify the authenticity of the data it receives from the fuze setter. As seen in FIG. 14, one embodiment for the public/private key encryption process 1400 for encrypting fuze setter data, the fuze setter data payload 1402 is processed with a hash algorithm 1404 for the fuze setter data that is intended to communicate or transfer to the fuze. This hash algorithm 1404 produces a hash value, which uniquely identifies the data payload and will indicate if there are any change in the data payload. The fuze setter processing then encrypts this hash value 1406 using a fuze setter private key 1408 and is then ready to transfer the encrypted hash 1410 to the fuze. The fuze set data payload 1412 in one example is also sent unencrypted and sent to the fuze.

As seen in FIG. 15 for the decryption process 1500 in one example, the fuze receives the encrypted hash 1502 and the fuze set data payload 1504. The encrypted hash 1502 is subject to decryption 1506 using the fuze public key 1508 to generate the hash value. The fuze uses the fuze set data payload 1504 using the same hash algorithm 1510 as the fuze setter to generate a local copy hash value. The system then compares 1512 the two hash values to see whether they match. If the hash values match, then this indicates that the data from the fuze setter was not altered or changed and is valid. If the hash values do not match, then the data may have been hacked or otherwise corrupted and the fuze would provide an indication alert. In such a scenario, the fuze might defer to pre-existing data, wait for authenticated fuze setter data or proceed with launch and obtain in-flight data.

Figure 16:
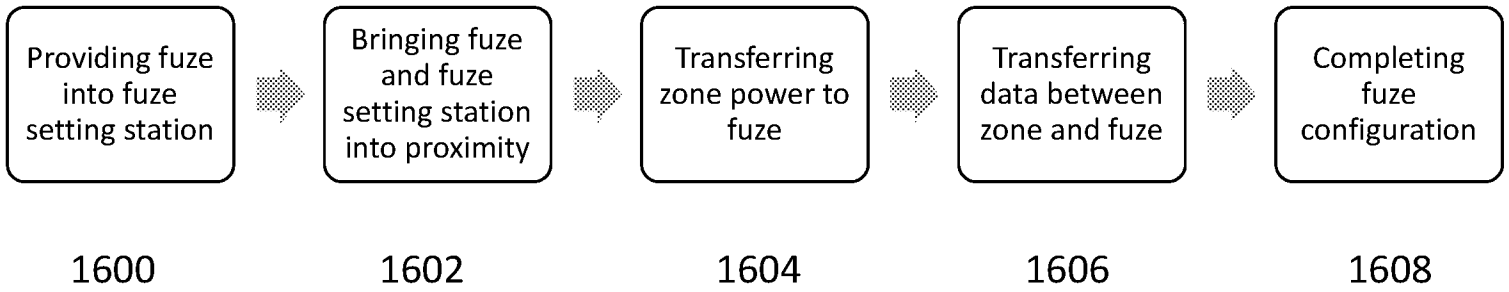
FIG. 16 is a flowchart depicting a method of fuze setting in accordance with the present disclosure according to one embodiment.

FIG. 16 depicts a method of setting a fuze in accordance with an embodiment of the present disclosure. A fuze is brought or otherwise moved into or near a fuze setting station 1600. The fuze then moves through the fuze setting zone 1602 which in one example is bringing the fuze into proximity of the fuze setting zone or vice versa by bringing the fuze setting station into proximity of the fuze. The fuze setting zone includes a communications zone and an electrical energy transfer zone. The electrical energy transfer zone is configured to power up the fuze 1604 which in one example transfers adequate power to power up the appropriate electronics or otherwise charge the fuze. The communications zone configures the fuze by transferring data necessary to complete configuration for launch 1606. This can be unilateral communication providing launch related information and may also include bilateral communication that extracts data from the fuze such as identification, maintenance, and existing configuration information. After the fuze setting process has completed 1608, the fully configured fuzed projectile can then be transferred into a feed tray to await launch or proceed directly with launch.

The foregoing description of the embodiments of the present disclosure has been presented for the purposes of illustration and description. It is not intended to be exhaustive or to limit the present disclosure to the precise form disclosed. Many modifications and variations are possible in light of this disclosure. It is intended that the scope of the present disclosure be limited not by this detailed description, but rather by the claims appended hereto.

A number of implementations have been described. Nevertheless, it will be understood that various modifications may be made without departing from the scope of the disclosure. Although operations are depicted in the drawings in a particular order, this should not be understood as requiring that such operations be performed in the particular order shown or in sequential order, or that all illustrated operations be performed, to achieve desirable results.

What is claimed is:

1. A wireless fuze setter interface, comprising:

an electronics subsystem comprising one or more ports; and one or more output interfaces having a common interface with the one or more ports on the electronics subsystem;

wherein the one or more output interfaces comprises, an electrical energy transfer zone configured to provide electrical energy to a fuze; and a high speed data communications zone configured to transfer fuze setting data to the fuze;

wherein the wireless fuze setter interface provides fuze setting capability without the need for rotational or other physical alignment between the fuze and fuze setter.

2. The wireless fuze setter interface of claim 1, wherein the electrical energy transfer zone comprises an electrical energy transfer coil.

3. The wireless fuze setter interface of claim 1, wherein the communications zone comprises a communications transceiver capable of bidirectional communications.

4. The wireless fuze setter interface of claim 3, wherein the communications transceiver comprises an antenna or an inductive coil.

5. The wireless fuze setter interface of claim 1, wherein at least one of the electrical energy transfer zone and the communications zone concurrently engages with two or more fuzes.

6. A wireless fuze setter interface for setting multiple fuzes on a projectile, comprising:

a fuze setter electronics subsystem comprising one or more ports; and one or more output interfaces having a common interface with the one or more ports on the electronics subsystem;

wherein the one or more output interfaces comprises, an electrical energy transfer zone configured to provide electrical energy to the fuze, wherein the electrical energy transfer zone spans a plurality of fuzes; and a high speed data communications zone configured to transfer fuze setting data to the fuze, wherein the communications zone spans a plurality of fuzes.

7. The wireless fuze setter interface of claim 6, wherein the electrical energy transfer zone is a single fuze electrical energy transfer zone coupled with a single fuze communications zone.

8. The wireless fuze setter interface of claim 6, wherein the electrical energy transfer zone is a multi-fuze electrical energy transfer zone coupled to a single fuze communications zone.

9. The wireless fuze setter interface of claim 6, wherein the electrical energy transfer zone is a multi-fuze electrical energy transfer zone coupled to a multi-fuze communications zone.

10. The wireless fuze setter interface of claim 6, wherein the communications zone comprises a communications transceiver capable of bidirectional communication and configured to wirelessly transfer the fuze setting data using near field magnetic induction.

11. The wireless fuze setter interface of claim 6, wherein the one or more output interfaces includes different fuze interfaces configured to engage with different fuze types.

12. The wireless fuze setter interface of claim 6, wherein the output interfaces includes a panel that extends across the multiple fuzes which are in close proximity to each other to allow for the electrical energy and fuze setting data transfers.

13. The wireless fuze setter interface of claim 6, wherein the electrical energy transfer zone is configured to provide the electrical energy to the fuze by magnetic resonance.

14. A method for wirelessly setting a fuze, comprising:

bringing the fuze into proximity of a fuze setting station, the fuze setting station comprising an electrical energy transfer zone and a communications zone;

powering up the fuze while in proximity to the electrical energy transfer zone; and configuring the fuze with fuze setting data while in proximity to the communications zone;

wherein the electrical energy transfer zone and the communications zone overlap with respect to the fuze, and wherein the fuze setting station provides fuze setting capability without the need for rotational or other physical alignment between the fuze and a fuze setter.

15. The method of claim 14, wherein configuring the fuze with fuze setting data is by near field magnetic induction.

16. The method of claim 14, further comprising powering up a plurality of fuzes concurrently in the electrical energy transfer zone.

17. The method of claim 14, further comprising configuring a plurality of fuzes concurrently in the communications zone.

18. The method of claim 14, further comprising public/private key cryptography on the fuze setting data.

* * * * *